United States Patent [19]

Nagai et al.

[11] Patent Number: 4,796,425

[45] Date of Patent: Jan. 10, 1989

[54] DOUBLE AIR-FUEL RATIO SENSOR SYSTEM CARRYING OUT LEARNING CONTROL OPERATION

[75] Inventors: Toshinari Nagai, Ann Arbor, Mich.; Nobuaki Kayanuma, Gotenba, Japan

[73] Assignee: Toyota Jidosha Kabushiki Kaisha, Aichi, Japan

[21] Appl. No.: 105,702

[22] Filed: Oct. 8, 1987

[30] Foreign Application Priority Data

Oct. 13, 1986 [JP] Japan ..... 61-241484

[51] Int. Cl.[4] ..... F02D 41/14

[52] U.S. Cl. ..... 60/274; 60/276; 60/285; 123/489

[58] Field of Search ..... 123/440, 489, 589; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32773 | 7/1982 | Japan . |
| 57-32774 | 7/1982 | Japan . |
| 57-32772 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72646 | 4/1983 | Japan . |
| 58-72647 | 4/1983 | Japan . |
| 58-135343 | 8/1983 | Japan . |
| 58-150038 | 9/1983 | Japan . |
| 58-152147 | 9/1983 | Japan . |
| 58-150039 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar

*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors. A center value of an air-fuel ratio correction amount or an air-fuel ratio feedback control parameter calculated based upon the output of the downstream-side air-fuel ratio sensor is calculated by a learning control for regions defined by the period of the output of the upstream-side air-fuel ratio sensor, and an air-fuel ratio feedback control is initiated by using the center value stored for the current region when the engine enters into an air-fuel ratio feedback control state, or when the period of the output of the upstream-side air-fuel ratio sensor is transferred to a different region.

44 Claims, 27 Drawing Sheets

| Fig. 4 A | Fig. 4 B | Fig. 4 C |
|---|---|---|

LEAN
RICH
A/F1
TDR
CDLY 0
t1
t2
t3
t4
t5
t6
t7
t8
TDL
A/F1'
(F1)

TDR
LEAN
RICH
(-TDL)
TDR

RSL
KIR
FAF1
RSR
KIL

| | | |
|---|---|---|
| Fig. 8 A | Fig. 8 B | Fig. 8 C |
| | Fig. 8 D | Fig. 8 E |

LEARNING CONTROL CONDITION DET. ROUTINE

901
F/B ?
NO
YES
902
70°C < THW < 90°C ?
NO
YES
903
LL="0" ?
NO
YES
904
IS DOWNSTREAM-SIDE O2 SENSOR ACTIVATED ?
NO
YES
905
Q/Ne > X1 ?
NO
YES
906
ΔQ < A ?
NO
YES
907
CΔQ ← CΔQ+1
908
CΔQ ← 0
909
CΔQ > B ?
NO
YES
910
FG ← "1"
911
FG ← "0"
RETURN
912

V
1
0
V1
VR1
RICH
LEAN
TDR
(-TDL)
F1
KIR
RSL
FAF1
RSR
KIL
V2
VR2
F2
RICH
KI2
RS2
FAF2
RS2
KI2
RS2

| Fig. 14 A | Fig. 14 B | Fig. 14 C |
|---|---|---|

V
1
0
V1
VR1

RICH
LEAN

TDR
(-TDL)
F1

KIR
RSL
FAF1
RSR
KIL

V
1
0
V2
VR2

LEAN
RICH
F2

MAX
RSR
MIN

MAX
RSL
MIN

LEAN
RICH
A/F1

TDL
CDLY
0
t1 t2 t3 t4 t5 t6 t7 t8
TDR
A/F1'
(F1)

(-TDR)
LEAN
RICH
TDL
(-TDR)

KIR
KIL
FAF1
RSL
RSR

DOUBLE AIR-FUEL RATIO SENSOR SYSTEM CARRYING OUT LEARNING CONTROL OPERATION

BACKGROUND OF THE INVENTION

1. Field of the Invention

The present invention relates to a method and apparatus for feedback control of an air-fuel ratio in an internal combustion engine having two air-fuel ratio sensors upstream and downstream of a catalyst converter disposed within an exhaust gas passage.

2. Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio. According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor in addition to an air-fuel ratio control operation carried out by the upstream-side $O_2$ sensor. In the double $O_2$ sensor system, although the downstream-side $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons.

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream-side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, an air-fuel ratio correction coefficient FAF2 or an air-fuel ratio feedback control parameter such as a skip amount RSR (RSL) controlled by the output of the downstream-side $O_2$ sensor in an air-fuel ratio feedback control state may be greatly deviated from such an air-fuel ratio correction coefficient or an air-fuel ratio feedback control parameter in a non air-fuel ratio feedback control (open control) state. As a result, in this case, when the engine control is changed from an open control state to an air-fuel ratio feedback control state by the upstream-side and downstream-side $O_2$ sensors, since the response speed of an air-fuel ratio feedback control operation by the downstream-side $O_2$ sensor is smaller than that of the upstream-side $O_2$ sensor, it will take a long time for the air-fuel ratio correction coefficient FAF2 or the skip amount RSR (RSL) to reach an optimum level, i.e., it will take a long time for the controlled air-fuel ratio to reach an optimum level, thereby causing an overrich or overlean condition in the controlled air-fuel ratio, and thus deteriorating the fuel consumption, the drivability, and the condition of the exhaust emissions such as HC, CO, and $NO_X$, since the air-fuel ratio correction coefficient FAF2 ($=0.1$) or the skip amount RSR (RSL) during an open-loop control is, in this case, not an optimum level, which is a problem.

Also, even during an air-fuel ratio feedback control by the downstream-side $O_2$ sensor, when the engine is transferred from one driving region to another driving region, the optimum level of the controlled air-fuel ratio is shifted, thus creating the above-mentioned problem.

Note, it has been disclosed in U.S. Ser. No. 903,977 that, in a double air-fuel ratio sensor system including two $O_2$ sensors upstream and downstream of a catalyst converter provided in an exhaust passage, an actual air-fuel ratio is adjusted by using the output of the upstream-side $O_2$ sensor and the output of the downstream-side $O_2$ sensor. A center value of the air-fuel ratio correction coefficient FAF2 or the air-fuel ratio feedback control parameter such as the skip amount RSR (RSL) is calculated by a learning control for each driving region defined by a load parameter such as the intake air amount Q, and an air-fuel ratio feedback control is initiated by using such a center value for the current driving region when the engine enters into an air-fuel ratio feedback control state or when the engine is transferred from one driving region to another driving region.

SUMMARY OF THE INVENTION

It is an object of the present invention to provide a double air-fuel ratio sensor system in an internal combustion engine with which the fuel consumption, the drivability, and the exhaust emission characteristics are improved after the engine enters into an air-fuel ratio feedback control by the downstream-side $O_2$ sensor and during an air-fuel ratio feedback control in which the engine is transferred from one driving region to another driving region.

According to the present invention, in a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors. A center value of an air-fuel ratio correction amount or an air-fuel ratio feedback control parameter calculated based upon the output of the downstream-side air-fuel ratio sensor is calculated by a learning control for regions defined by the period of the output of the upstream-side air-fuel ratio sensor, and an air-fuel ratio feedback control is initiated by using the center value stored for the current region when the engine enters into an air-fuel ratio feedback control state, or when the period of the output of the upstream-side air-fuel ratio sensor is transferred to a different region.

BRIEF DESCRIPTION OF THE DRAWINGS

The present invention will be more clearly understood from the description as set forth below with reference to the accompanying drawings, wherein:

FIG. 19 is a modification of FIG. 4; and

DESCRIPTION OF THE PREFERRED EMBODIMENTS

Figure 1:
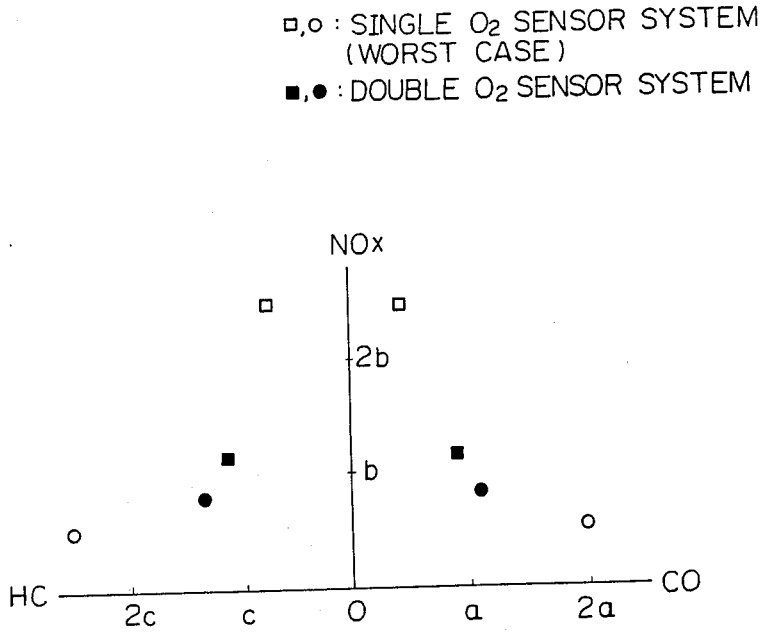
FIG. 1 is a graph showing the emission characteristics of a single $O_2$ sensor system and a double $O_2$ sensor system.
Figure 2A:
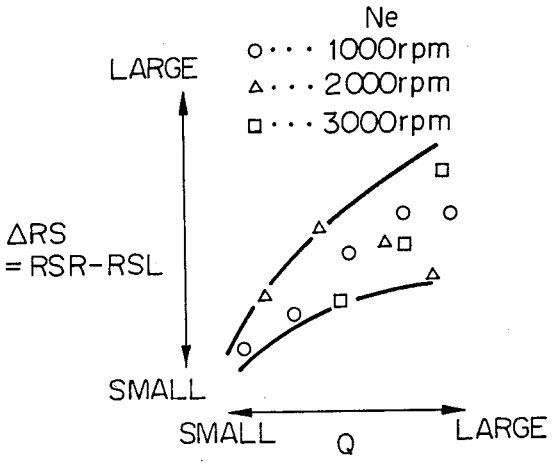
FIGS. 2A and 2B are graphs for explaining the principle of the present invention.
Figure 2B:
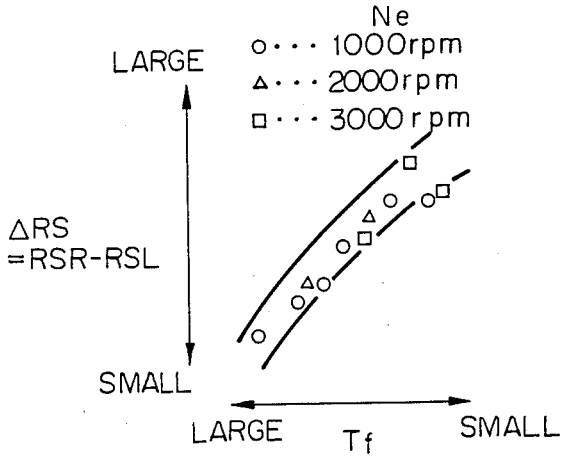

First, the principle of the present invention will be explained with reference to FIGS. 2A and 2B. FIG. 2A shows the characteristics of a required correction amount $\Delta RS$ ($=RSL-RSL$) where an air-fuel ratio feedback correction amount such as skip amounts RSR and RSL are calculated by a learning control for regions defined by an engine load parameter such as the intake air amount Q, and FIG. 2B shows the characteristics of a required correction amount $\Delta RS$ ($=RSL-RSL$) where an air-fuel ratio feedback correction amount such as skip amounts RR and RSL are calculated by a learning control for regions defined by an output period $T_f$ of the upstream-side $O_2$ sensor. As is clear from FIGS. 2A and 2B, at any driving state defined by the engine speed Ne, the relationship between the output period $T_f$ of the upstream-side $O_2$ sensor and the required correction amount $\Delta RS$ is more powerful than the relationship between the intake air amount Q and the required correction amount $\Delta RS$. This is because when the upstream-side $O_2$ sensor is only slightly exposed to the gas to increase the repetition frequency of the air-fuel ratio from the rich side to the lean side and vice verse, the output period $T_f$ of the downstream-side $O_2$ sensor is reduced. Another reason is that a general $O_2$ sensor has a characteristic in that the output period $T_f$ thereof is increased, when the air-fuel ratio is lean. That is, the deviation of the mean air-fuel ratio from an optimum level by the air-fuel ratio feedback by the upstream-side $O_2$ sensor is dependent upon the gas exposure thereto and the sensor characteristic is relevant to the output period $T_f$ of the upstream-side $O_2$ sensor. On the other hand, in a double $O_2$ sensor system, since the deviation of the mean air-fuel ratio from the optimum level is compensated for by the downstream-side $O_2$ sensor, this deviation is relevant to the air-fuel ratio feedback correction amount such as $\Delta RS$ by the air-fuel ratio feedback control by the downstream-side air-fuel ratio sensor. Thus, the air-fuel ratio feedback correction amount such as skip amounts RSR and RSL is preferably calculated by a learning control for regions defined by the output period $T_f$ of the upstream-side $O_2$ sensor, compared with regions defined by the engine load parameter such as the intake air amount Q.

Note that, both FIGS. 2A and 2B show the case where the base air-fuel ratio is lean.

Figure 3:
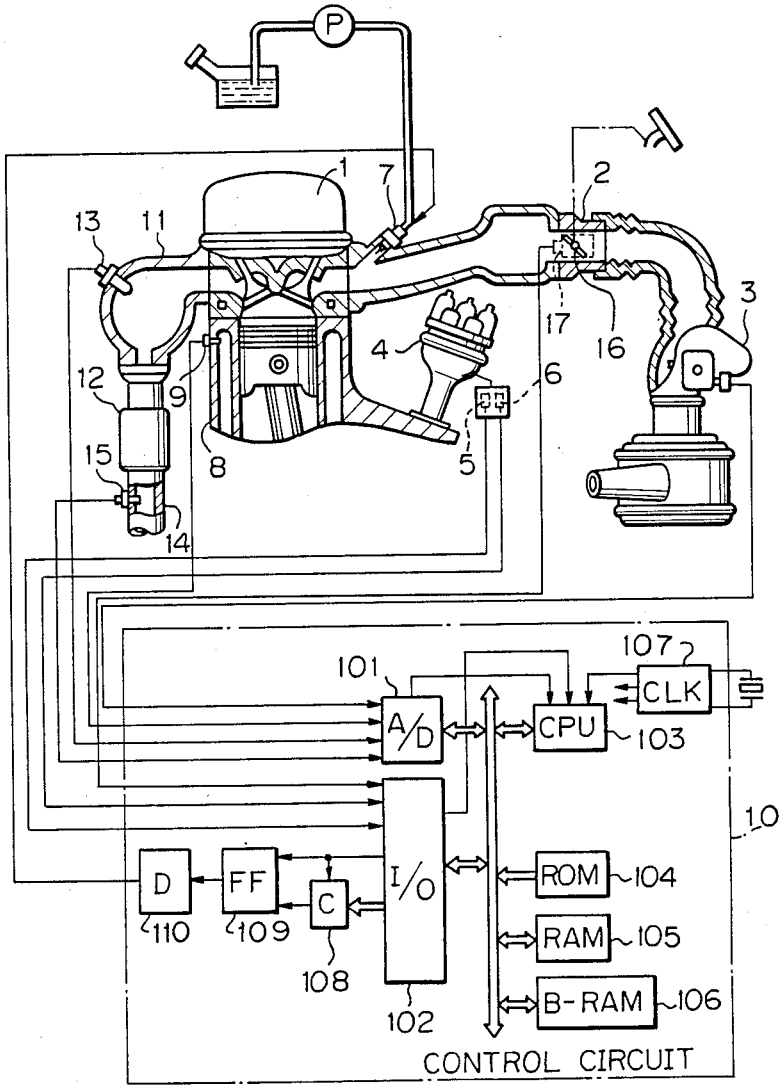
FIG. 3 is a schematic view of an internal combustion engine according to the present invention.

In FIG. 3, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1. In this case, the crankangle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/0) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, though not shown in FIG. 3.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

Reference 16 designates a throttle valve, and 17 an idle switch for detecting whether or not the throttle valve 16 is completely closed.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned OFF.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 3, will be now explained.

Figures 4, 4A:
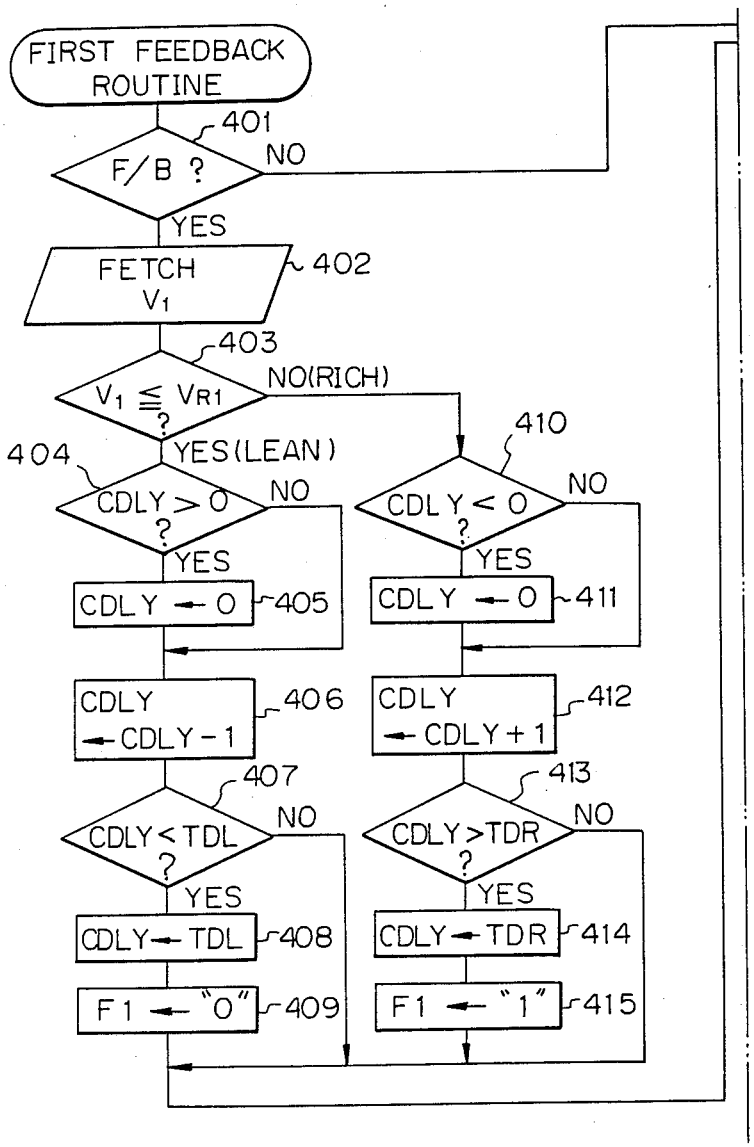
FIGS. 4, 4A–4C, 5, 6, 8, 8A–8E, 9, 10, 11, 14, 14A–14C, 15, 16, and 19 are flow charts showing the operation of the control circuit of FIG. 2.
Figure 4B:
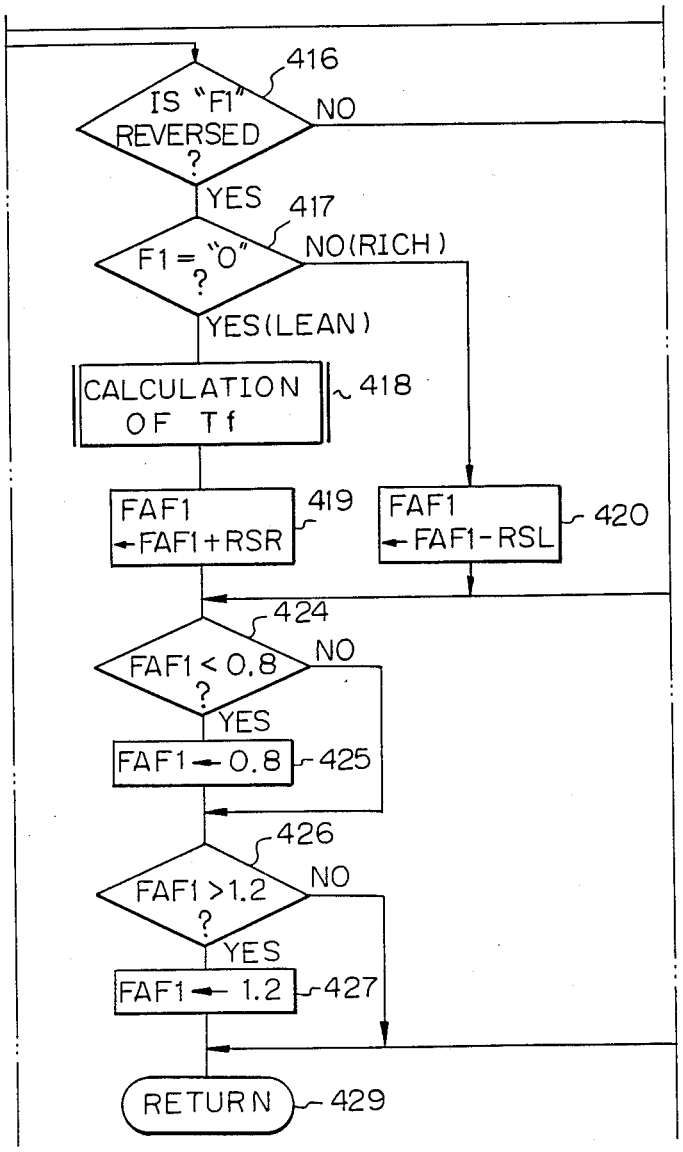
Figure 4C:
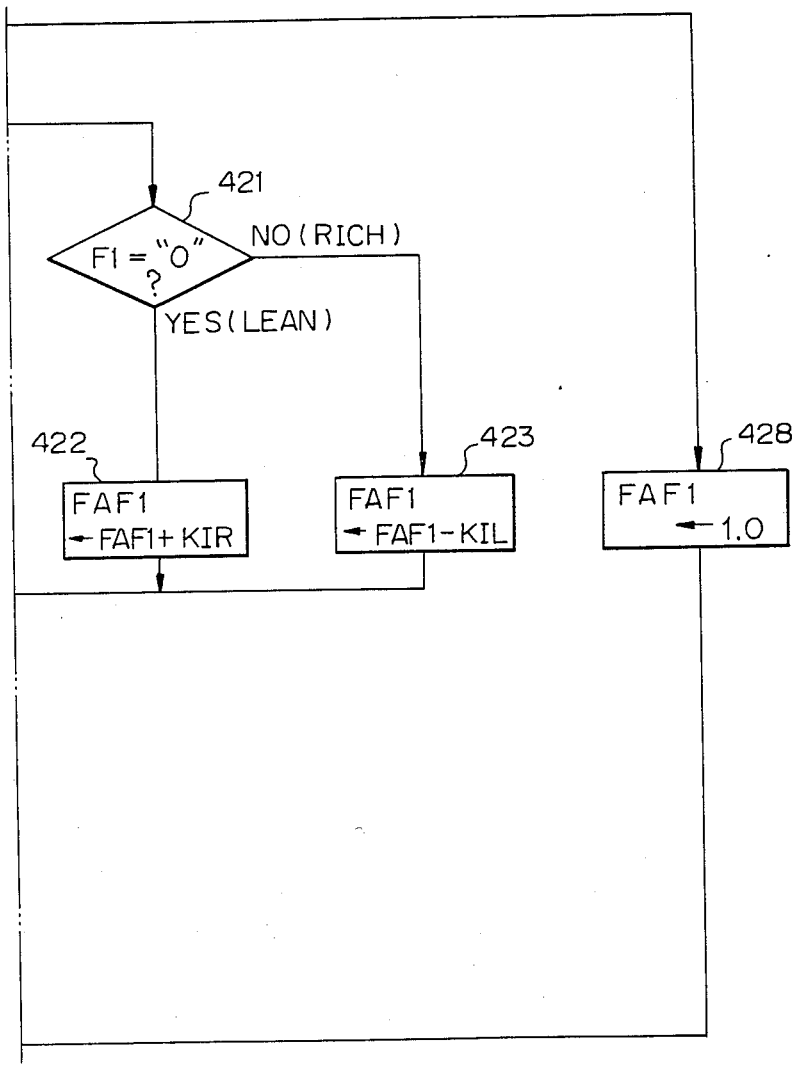

FIG. 4 is a routine for calculating a first air-fuel ratio feedback correction amount FAF1 in accordance with the output of the upstream-side $O_2$ sensor 13 executed at every predetermined time period such as 4 ms.

At step 401, it is determined whether or not all feedback control (closed-loop control) conditions by the upstream-side $O_2$ sensor 13 are satisfied. The feedback control conditions are as follows:

(i) the engine is not in the starting state;
(ii) the coolant temperature THW is higher than 50° C.;
(iii) the power fuel incremental amount FPOWER is 0; and
(iv) the upstream-side $O_2$ sensor 13 is in an activated state.

Note that the determination of activation/non-activation of the upstream-side $O_2$ sensor 13 is carried out by determining whether or not the coolant temperature THW $\geqq$70° C., or by whether of not the output of the upstream-side $O_2$ sensor 13 is once swung, i.e., one changed from the rich side to the lean side, or vice versa. Of course, other feedback control conditions are introduced as occasion demands. However, an explanation of such other feedback control condition is omitted.

If one or more of the feedback control conditions is not satisfied, the control proceeds to step 428, in which the amount FAF1 is caused to be 1.0 (FAF1=1.0), thereby carrying out an open-loop control operation.

Contrary to the above, at step 401, if all of the feedback control conditions are satisfied, the control proceeds to step 402.

At step 402, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ sensor 13 is on the rich side or on the lean side with respect to the stoichiometric air-fuel ratio.

If $V_1 \leqq V_{R1}$, which means that the current air-fuel ratio is lean, the control proceeds to step 404, which determines whether or not the value of a delay counter CDLY is positive. If CDLY>0, the control proceeds to step 405, which clears the delay counter CDLY, and then proceeds to step 406. If CDLY$\leqq$0, the control proceeds directly to step 406. At step 406, the delay counter CDLY is counted down by 1, and at step 407, it is determined whether or not CDLY<TDL. Note that TDL is a lean delay time period for which a rich state is maintained even after the output of the upstream-side $O_2$ sensor 13 is changed from the rich side to the lean side, and is defined by a negative value. Therefore, at step 407, only when CDLY<TDL does the control proceed to step 408, which causes CDLY to be TDL, and then to step 409, which causes a first air-fuel ratio flag F1 to be "0", (lean state). On the other hand, if $V_1 > V_{R1}$, which means that the current air-fuel ratio is rich, the control proceeds to step 410, which determines whether or not the value of the delay counter CDLY is negative. If CDLY<0, the control proceeds to step 411, which clears the delay counter CDLY, and then proceeds to step 412. If CDLY$\leqq$0, the control directly proceeds to 412. At step 412, the delay counter CDLY is counted up by 1, and at step 413, it is determined whether or not CDLY>TDR. Note that TDR is a rich delay time period for which a lean state is maintained even after the output of the upstream-side $O_2$ sensor 13 is changed from the lean side to the rich side, and is defined by a positive value. Therefore, at step 413, only when CDLY>TDR does the control proceed to step 414, which causes CDLY to be TDR, and then to step 415, which causes the air-fuel ratio flag F1 to be "1" (rich state).

Next, at step 416, it is determined whether or not the air-fuel ratio flag Fl is reversed, i.e., whether or not the delayed air-fuel ratio detected by the upstream-side $O_2$ sensor 13 is reversed. If the first air-fuel ratio flag F1 is reversed, the control proceeds to steps 417 to 420, which carry out a skip operation and a period calculation. That is, at step 417, if the flag F1 is "0" (lean) the control proceeds to step 418, at which a period $T_f$ of the output of the upstream-side $O_2$ sensor 13 is calculated, as later explained. Also, the control proceeds to step 419, which remarkably increases the correction amount FAF1 by a rich skip amount RSR. Also, if the flag F1 is "1" (rich) at step 417, the control proceeds to step 420, which remarkably decreases the correction amount FAF1 by a lean skip amount RSL.

On the other hand, if the first air-fuel ratio flag F1 is not reversed at step 416, the control proceeds to step 421 to 423, which carry out an integration operation. That is, if the flag F1 is "0" (lean) at step 421, the control proceeds to step 422, which gradually increases the correction amount FAF1 by a rich integration amount KIR. Also, if the flag F1 is "1" (rich) at step 421, the control proceeds to step 423, which gradually decreases the correction amount FAF1 by a lean integration amount KIL.

The correction amount FAF1 is guarded by a minimum value 0.8 at steps 424 and 425, and by a maximum value 1.2 at steps 426 and 427, thereby also preventing the controlled air-fuel ratio from becoming overrich or overlean.

The correction amount FAF1 is then stored in the RAM 105, thus completing this routine of FIG. 4 at step 429.

Figure 5:
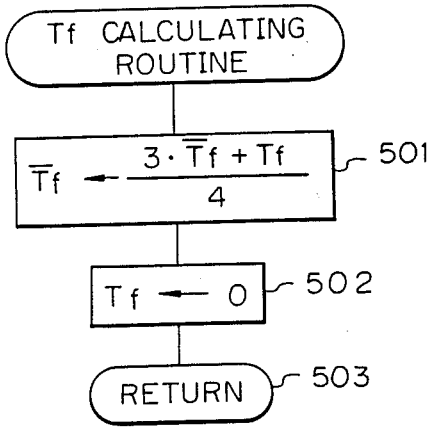
Figure 6:
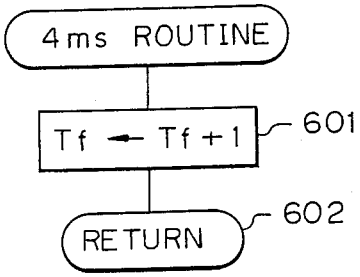

FIG. 5 is a detailed flow chart of step 418 of FIG. 4. At step 501, a blunt value $T_f$ of a counter $T_f$ is calculated by $$\overline{T}_f \leftarrow \frac{3 \cdot \overline{T}_f + T_f}{4}$$

and is stored in the RAM 105. Next, at step 502, the counter $T_f$ is cleared, and thus the flow is completed by step 503. Note that the counter $T_f$ is always counted up by a timer routine as illustrated in FIG. 6. Therefore, since the routine of FIG. 5 is carried out every time the output $V_1$ of the upstream-side $O_2$ sensor 13 is switched from the rich side to the lean side, the value of the counter $T_f$ shows a period of the output $V_1$ of the upstream-side $O_2$ sensor 13.

Figures 7A, 7B, 7C, 7D:
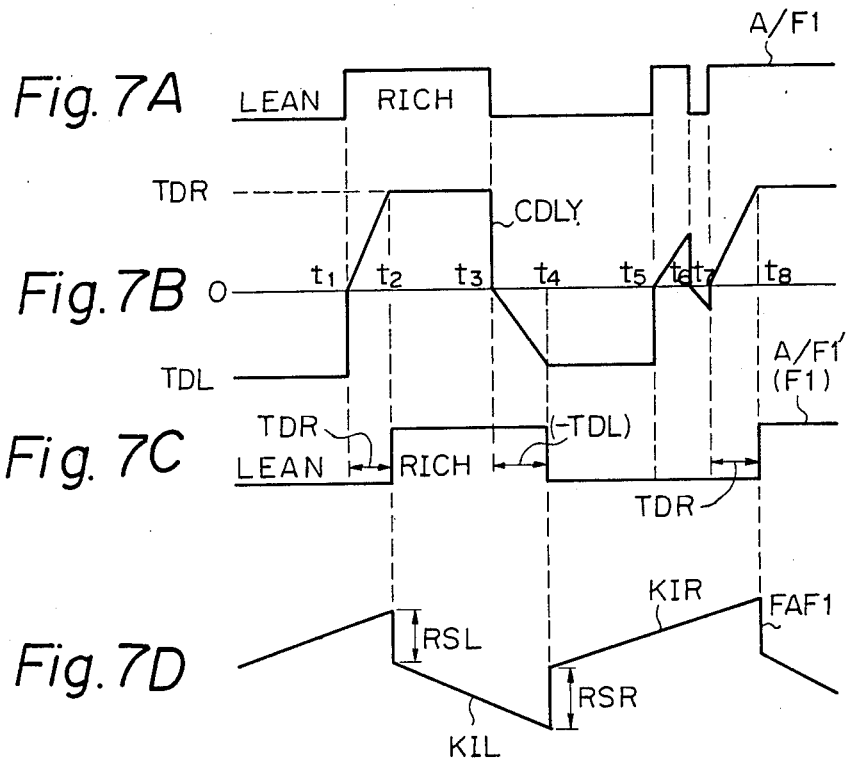
FIGS. 7A through 7D are timing diagrams explaining the flow chart of FIG. 6.

The operation by the flow chart of FIG. 4 will be further explained with reference to FIGS. 7A through 7D. As illustrated in FIG. 7A, when the air-fuel ratio A/F1 is obtained by the output $V_1$ of the upstream-side $O_2$ sensor 13, the delay counter CDLY is counted up during a rich state, and is counted down during a lean state, as illustrated in FIG. 7B. As a result, a delayed air-fuel ratio corresponding to the first air-fuel ratio flag F1 is obtained as illustrated in FIG. 7C. For example, at time $t_1$, even when the air-fuel ratio A/F is changed from the lean side to the rich side, the delayed air-fuel ratio A/F1' (F1) is changed at time $t_2$ after the rich delay time period TDR. Similarly, at time $t_3$, even when the air-fuel ratio A/F1 is changed from the rich side to the lean side, the delayed air-fuel ratio F1 is changed at time $t_4$ after the lean delay time period TDL. However, at time $t_5$, $t_6$, or $t_7$, when the air-fuel ratio A/F1 is reversed within a smaller time period than the rich delay time period TDR or the lean delay time period TDL, the delay air-fuel ratio A/F1' is reversed at time $t_8$. That is, the delayed air-fuel ratio A/F1' is stable when compared with the air-fuel ratio A/F1. Further, as illustrated in FIG. 7D, at every change of the delayed air-fuel ratio A/F1 from the rich side to the lean side, or vice versa, the correction amount FAF1 is skipped by the skip amount RSR or RSL, and also, the correction amount FAF1 is gradually increased or decreased in accordance with the delayed air-fuel ratio A/F1'.

Air-fuel ratio feedback control operations by the downstream-side $O_2$ sensor 13 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air-fuel ratio feedback control parameter, there are nominated a delay time period TD (in more detail, the rich delay time period TDR and the lean delay time period TDL), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes larger than the lean delay time period (TDR>(−TDL)), the controlled air-fuel ratio becomes richer, and if the lean delay time period becomes larger than the rich delay time period ((−TDL)>TDR), the controlled air-fuel ratio becomes leaner. Thus, the air-fuel ratio can be controlled by changing the rich delay time period TDR and the lean delay time period (−TDL) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output of the downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference volta $V_{R1}$ in accordance with the output of the downstream side $O_2$ sensor 15.

There are various merits in the control of the air-fuel ratio feedback control parameters by the output $V_2$ of the downstream-side $O_2$ sensor 15. For example, when the delay time periods TDR and TDL are controlled by the output $V_2$ of the downstream-side $O_2$ sensor 15, it is possible to precisely control the air-fuel ratio. Also, when the skip amounts RSR and RSL are controlled by the output $V_2$ of the downstream-side $O_2$ sensor 15, it is possible to improve the response speed of the air-fuel ratio feedback control by the output $V_2$ of the downstream-side $O_2$ sensor 15. Of course, it is possible to simultaneously control two or more kinds of the air-fuel ratio feedback control parameters by the output $V_2$ of the downstream-side $O_2$ sensor 15.

A double $O_2$ sensor system into which a second air-fuel ratio correction amount FAF2 is introduced will be explained with reference to FIGS. 8, 9, 10, and 11.

Figures 8, 8A:
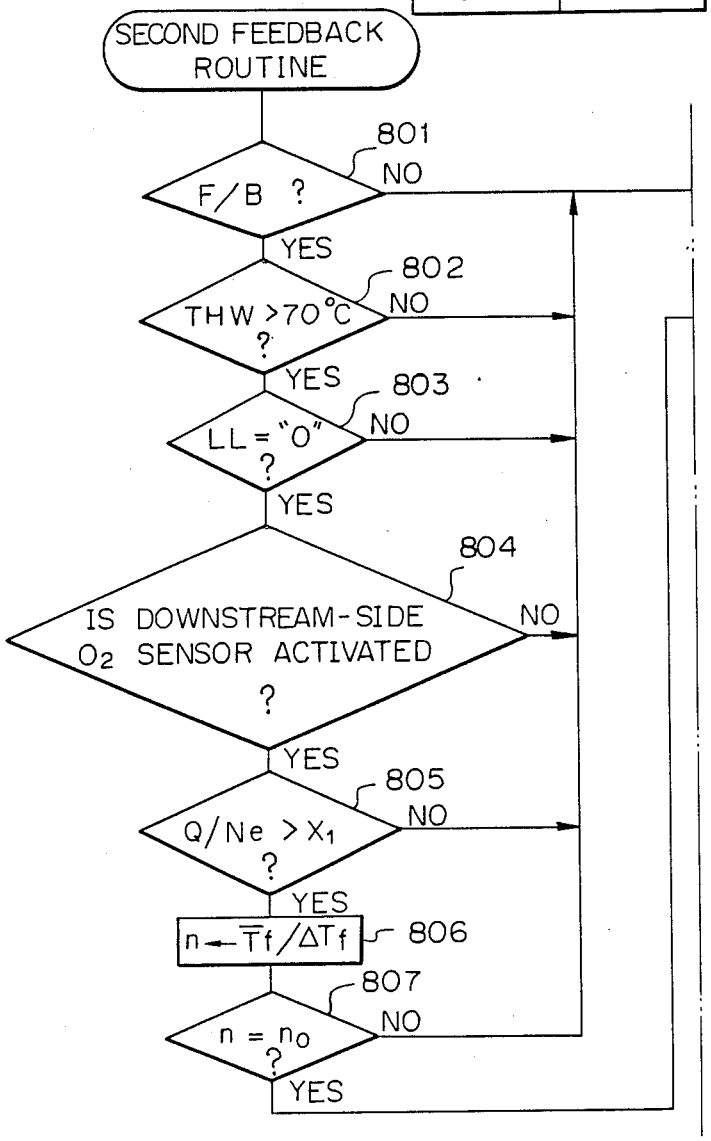
Figure 8B:
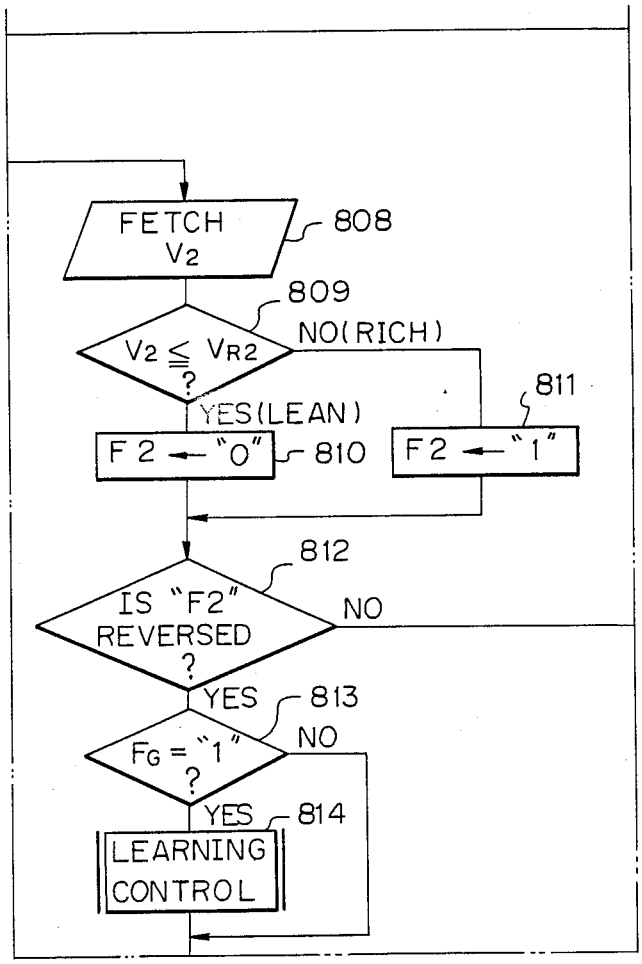
Figure 8C:
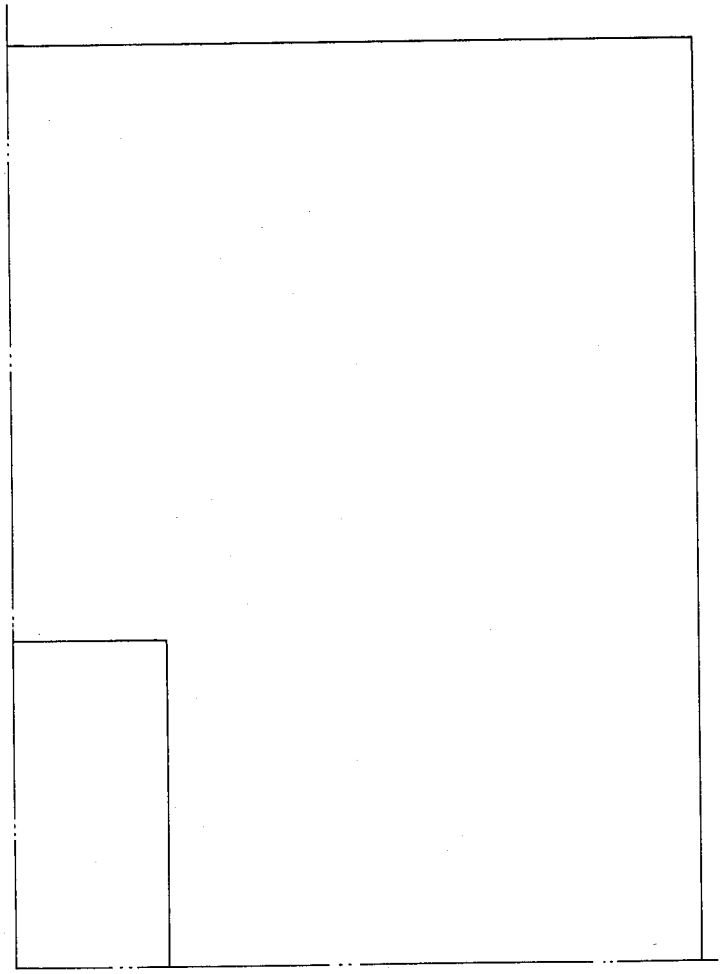
Figure 8D:
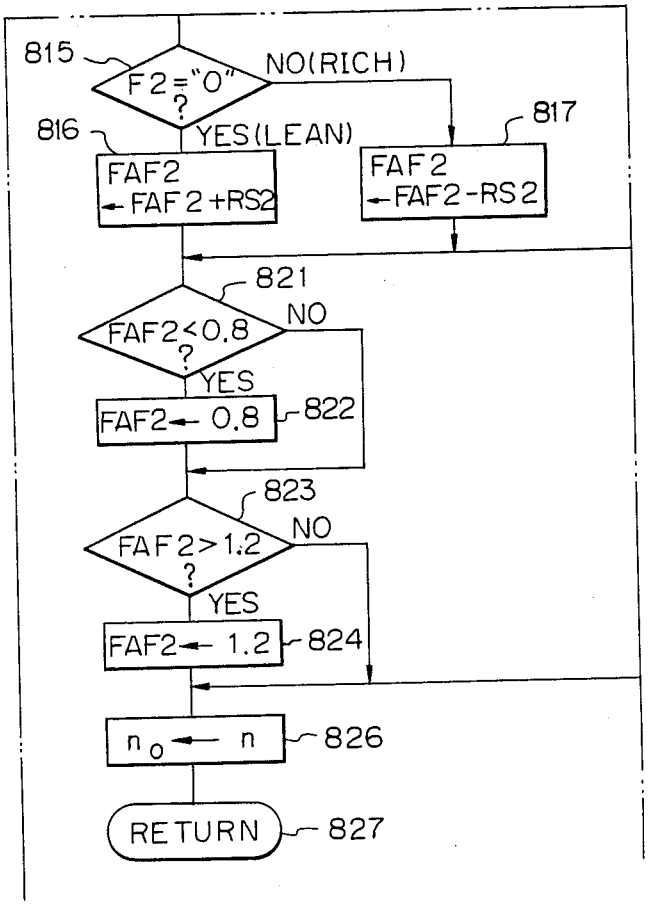
Figure 8E:
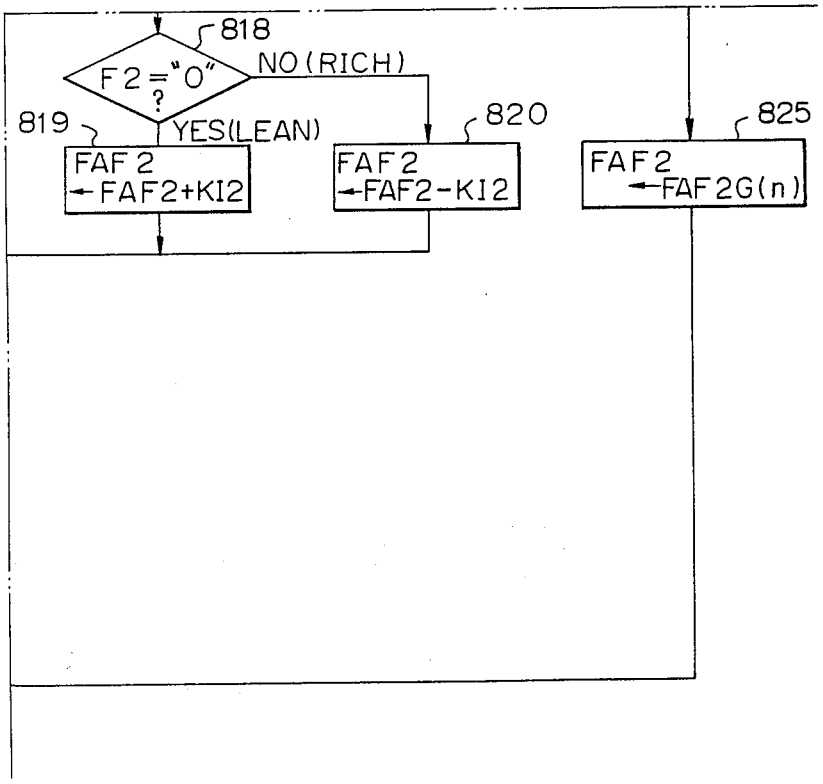

FIG. 8 is a routine for calculating a second air-fuel ratio feedback correction amount FAF2 in accordance with the output of the downstream-side $O_2$ sensor 15 executed at every predetermined time period such as 1 s.

At steps 801 through 805, it is determined whether or not all of the feedback control (closed-loop control) conditions by the downstream-side $O_2$ sensor 15 are satisfied. For example, at step 801, it is determined whether or not the feedback control conditions by the upstream-side $O_2$ sensor 13 are satisfied. At step 802, it is determined whether or not the coolant temperature THW is higher than 70° C. At step 803, it is determined whether or not the throttle valve 16 is open (LL="0"). At step 804, it is determined whether or not the output of the downstream-side $O_2$ sensor 15 has been once changed from the lean side to the rich side or vice versa. At step 805, it is determined whether or not a load parameter such as Q/Ne is larger than a predetermined value $X_1$. Of course, other feedback control conditions are introduced as occasion demands. However, an explanation of such other feedback control conditions is omitted..

If one or more of the feedback control conditions is not satisfied, the control also proceeds to step 825, thereby carrying out an open-loop control operation. Contrary to this, if all of the feedback control conditions are satisfied, the control proceeds to step 806, which reads the blunt value $\bar{t}$HD f of the period $T_f$ calculates $$n \leftarrow \bar{T}_f/\Delta T_f$$

where $\Delta T_f$ is a constant. Note that n is an integer, and accordingly, fractions of $\bar{t}_f/\Delta T_f$ are omitted. Thus, the blunt value $\bar{t}$HD f is divided into a plurality of regions n:

$$\text{region 0: } 0 \leqq \bar{T}_f 21\ \Delta T_f$$

$$\text{region 1: } \Delta T_f 23\ \bar{T}_f 21\ 2 \cdot \Delta T_f$$

$$\text{region k: } k \cdot \Delta T_f \leqq \bar{T}_f 21\ (k+1) \cdot \Delta T_f$$

At step 807, it is determined whether or not the current region n is the same as the previous driving region $n_0$. As a result, if $n = n_0$, the control proceeds to step 808. Otherwise, the control proceeds to step 825.

Therefore, when the air-fuel ratio feedback control conditions by the downstream-side $O_2$ sensor 15 are not satisfied, or when the driving region n is changed, at step 825, the second air-fuel ratio correction coefficient FAF2 is made the learning value FAF2G(n) for the corresponding driving region n. Note that the learning values FAF2G(n) are stored in the backup RAM 106 as follows:

| n | FAF2G |
|---|---|
| 0 | FAF2G(0) |
| 1 | FAF2G(1) |
| . | . |
| . | . |
| . | . |
| k | FAF2G(k) |
| . | . |
| . | . |
| . | . |

At step 808, an A/D conversion is performed upon the output voltage $V_2$ of the downstream-side $O_2$ sensor 15, and the A/D converted value thereof is then fetched from the A/D converter 101. Then, at step 809, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher than the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. As a result, if the air-fuel ratio is rich, a second air-fuel ratio flag F2 is made "1", and if the air-fuel ratio is lean, the second air-fuel ratio flag F2 is made "0".

Next, at step 812, it is determined whether or not the second air-fuel ratio flag F2 is reversed. If the second air-fuel ratio flag F2 is reversed, the control proceeds to steps 813 to 817, which carry out a learning control operation and a skip operation.

At step 813, it is determined whether or not all the learning conditions are satisfied, i.e., a learning control execution flag FG is "1". Only if all the learning conditions are satisfied does the control proceed to step 814, which carries out a learning control operation. The steps 813 and 814 will be later explained with reference to FIGS. 9 and 10.

Steps 815 to 817 carry out a skip operation. That is, if the flag F2 is "0" (lean) at step 815, the control proceeds to step 816, which remarkably increases the second correction amount FAF2 by skip amount RS2. Also, if the flag F2 is "1" (rich) at step 815, the control proceeds to step 817, which remarkably decreases the second correction amount FAF2 by the skip amount RS2.

On the other hand, if the second air-fuel ratio flag F2 is not reversed at step 812, the control proceeds to steps 818 to 820, which carries out an integration operation. That is, if the flag F2 is "0" (lean) at step 818, the control proceeds to step 819, which gradually increases the second correction amount FAF2 by an integration amount KI2. Also, if the flag F2 is "1" (rich) at step 818, the control proceeds to step 820, which gradually decreases the second correction amount FAF2 by the integration amount KI2.

Note that the skip amount RS2 is larger than the integration amount KI2.

The second correction amount FAF2 is guarded by a minimum value 0.8 at steps 821 and 822, and by a maximum value 1.2 at steps 823 and 824, thereby also preventing the controlled air-fuel ratio from becoming overrich or overlean.

At step 826, the region n is stored as the previous driving region $n_0$ in the RAM 105 in order to execute the next operation.

The correction amount FAF2 is then stored in the RAM 105, thus completing this routine of FIG. 8 at step 827.

Figure 9:
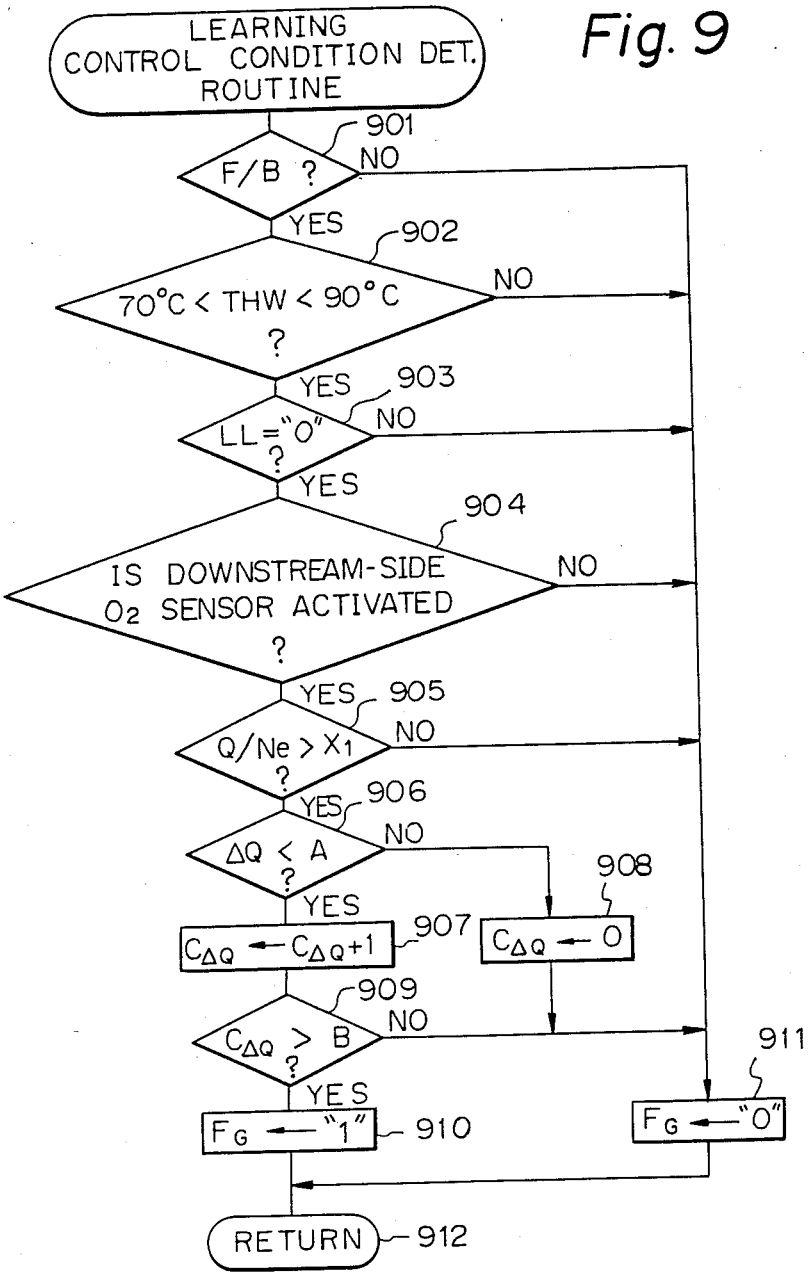

FIG. 9 is a routine for calculating the learning control executing flag $F_G$, executed at every predetermined time period such as 1 s or at every predetermined crank angle such as 180° CA. Steps 901 through 905 correspond to steps 801 through 805, respectively. However, at step 902, it is determined whether or not the coolant temperature THW is within a range of 70° C. to 90° C., which means that the coolant temperature THW is stable. At step 906, it is determined whether or not a change $\Delta Q$ of the intake air amount Q per 1 s of 180° CA is smaller than a predetermined value A. As a result, if $\Delta Q<A$, the control proceeds to step 907 which counts up a counter $C_{\Delta Q}$. Otherwise, the counter $C_{\Delta Q}$ is reset by step 908. Further, at step 909, it is determined whether or not $C_{\Delta Q}>B$ (definite value). As a result, only if $C_{\Delta Q}>B$ does the control proceed to step 910, which sets the learning control execution flag $F_G$. Otherwise, the learning control execution flag $F_G$ is reset at step 911. Thus, the routine of FIG. 9 is completed by step 912.

Thus, according to the routine of FIG. 9, under the conditions that the air-fuel ratio feedback controls by the two $O_2$ sensors 13 and 15 are carried out, only when the coolant temperature THW is stable, and in addition, the change of the engine load parameter such as the intake air amount Q is stable, is the learning control execution flag $F_G$ set, thereby carrying out a learning control.

Note, other learning control conditions can be introduced as occasion demands.

Figure 10:
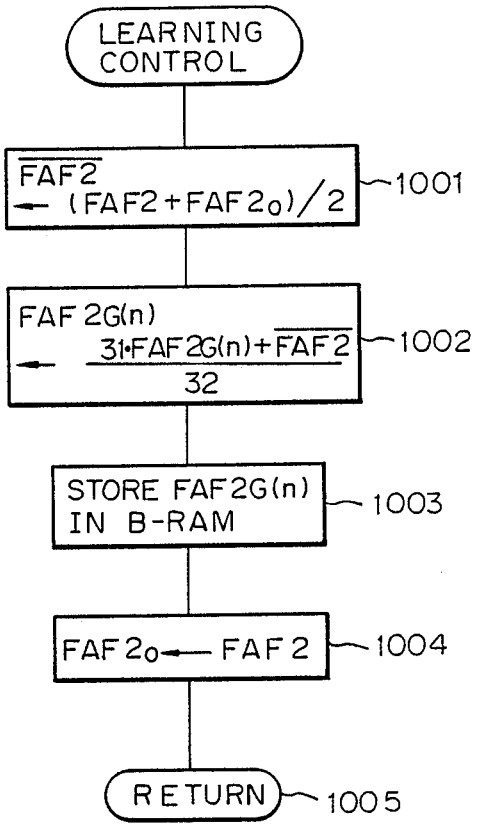

FIG. 10 is a detailed routine of the learning control steps 814 of FIG. 8. As explained above, this routine is carried out when the output $V_2$ of the downstream-side $O_2$ sensor 15 is reversed and all the learning conditions are satisfied. At step 1001, a mean value $\overline{FAF2}$ of the second air-fuel ratio correction coefficient FAF2 is calculated by $$\overline{FAF2} \leftarrow (FAF2+FAF2_0)/2$$

where $FAF2_0$ is a value of the second air-fuel ratio correction coefficient FAF2 fetched previously at a skip operation. That is, the mean value $\overline{FAF2}$ is a mean value of two successive values of the second air-fuel ratio correction coefficient FAF2 immediately before the skip operation. Next, at step 702', the learning value FAF2G(n) for the current region n is renewed by $$FAF2G(n) \leftarrow \frac{31 \cdot FAF2G(n) + \overline{FAF2}}{32}$$

Then, at step 1003, the learning value FAF2G(n) is stored in the corresponding area of the backup RAM 106, and at step 1004, in order to prepare the next execution, $$FAF2_0 \leftarrow FAF2$$

Thus, the routine of FIG. 10 is completed by step 1005.

Thus, a learning control operation is performed upon the second air-fuel ratio correction coefficient FAF2 and the obtained learning value FAF2G(n) is used as the second air-fuel ratio correction amount FAF2 at the start of the air-fuel ratio feedback control by the downstream-side $O_2$ sensor 15, and at the change of regions of the period $\overline{T}_f$ in an air-fuel ratio feedback control.

Figure 11:
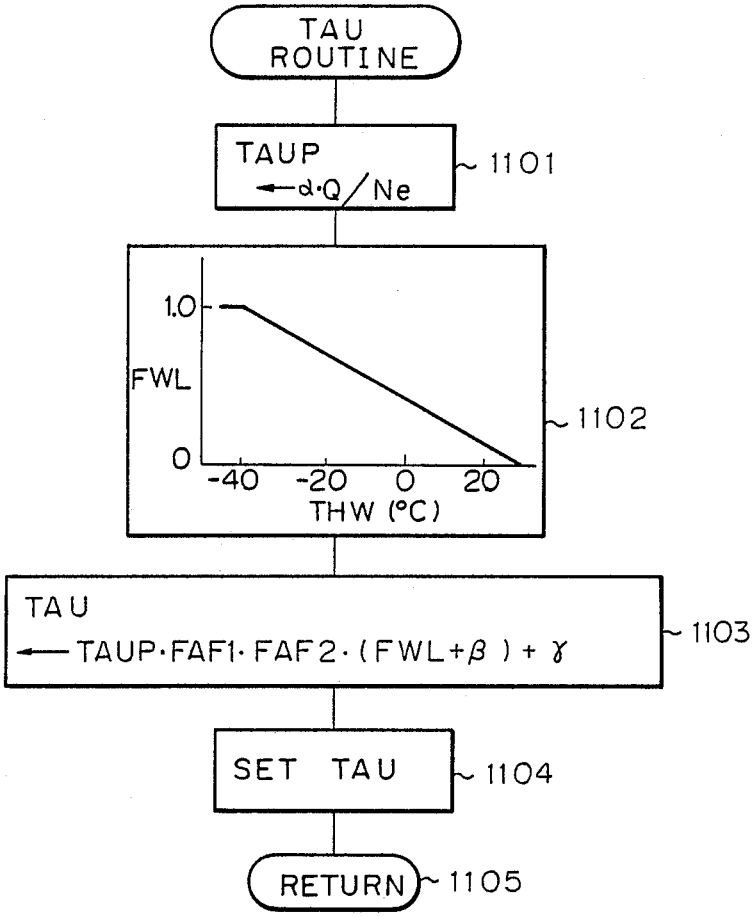

FIG. 11 is a routine for calculating a fuel injection amount TAU executed at every predetermined crank angle such as 360° CA. At step 1101, a base fuel injection amount TAUP is calculated by using the intake air amount data Q and the engine speed data Ne stored in the RAM 105. That is, $$TAUP \leftarrow \alpha \cdot Q/Ne$$

where $\alpha$ is a constant. Then at step 1102, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 1103, a final fuel injection amount TAU is calculated by $$TAU \leftarrow TAUP \cdot FAF1 \cdot FAF2 \cdot (FWL+\beta)+\gamma$$

Where $\beta$ and $\gamma$ are correction factors determined by other parameters such as the voltage of the battery and the temperature of the intake air. At step 1103, the final fuel injection amount TAU is set in the down counter 107, and in addition, the flip-flop 108 is set initiate the activation of the fuel injection valve 7. Then, this routine is completed by step 1104. Note that, as explained above, when a time period corresponding to the amount TAU passes, the flip-flop 109 is reset by the carry-out signal of the down counter 108 to stop the activation of the fuel injection valve 7.

Figures 12A, 12B, 12C, 12D, 12E, 12F, 12G:
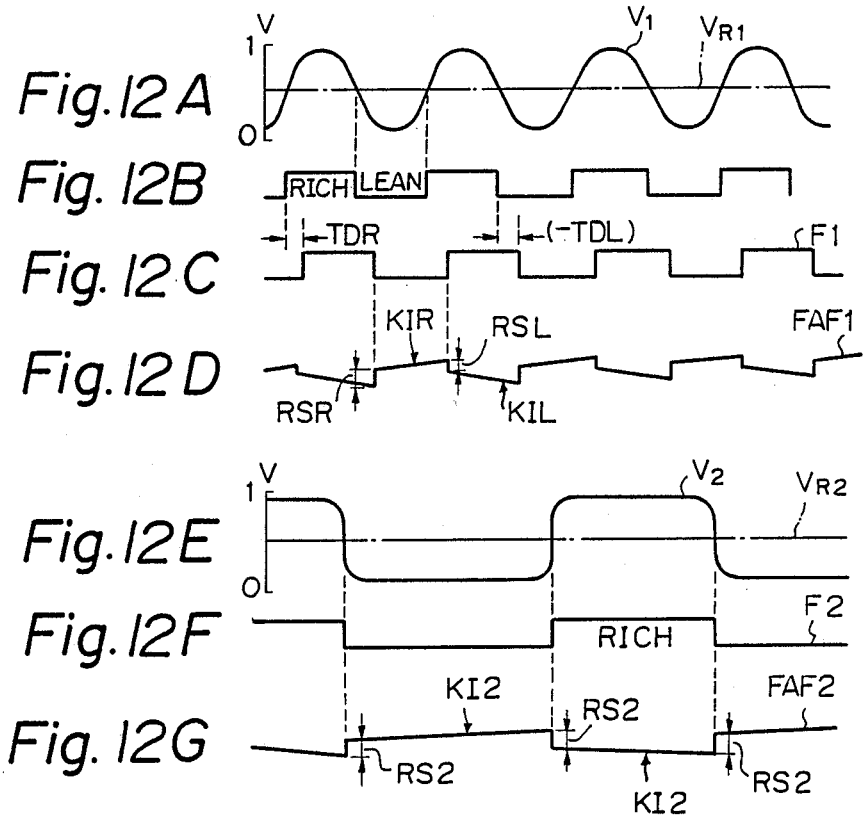
FIGS. 12A through 12G, 13A, and 13B are timing diagrams explaining the flow charts of FIGS. 4, 4A–4C, 5, 6, 8, 8A–8E, 9, 10, and 11.

FIGS. 12A through 12G are timing diagrams for explaining the two air-fuel ratio correction amounts FAF1 and FAF2 obtained by the flow charts of FIGS. 4, 5, 6, 8, 9, 10, and 11. In this case, the engine is in a closed-loop control state for the two $O_2$ sensors 13 and 15. When the output of the upstream-side $O_2$ sensor 13 is changed as illustrated in FIG. 12A, the determination at step 403 of FIG. 4 is shown in FIG. 12B, and a delayed determination thereof corresponding to the first air-fuel ratio flag F1 is shown in FIG. 12C. As a result, as shown in FIG. 12D, every time the delayed determination is changed from the rich side to the lean side, or vice versa, the first air-fuel ratio correction amount FAF1 is skipped by the amount RSR or RSL. On the other hand, when the output of the downstream-side $O_2$ sensor 15 is changed as illustrated in FIG. 12E, the determination at step 809 of FIG. 8 corresponding to the second air-fuel ratio flag F2 is shown in FIG. 12F. As a result, as shown in FIG. 12G, every time the determination is changed from the rich side to the lean side, or vice versa, the second air-fuel ratio correction amount FAF2 is skipped by the skip amount RS2.

Figures 13A, 13B:
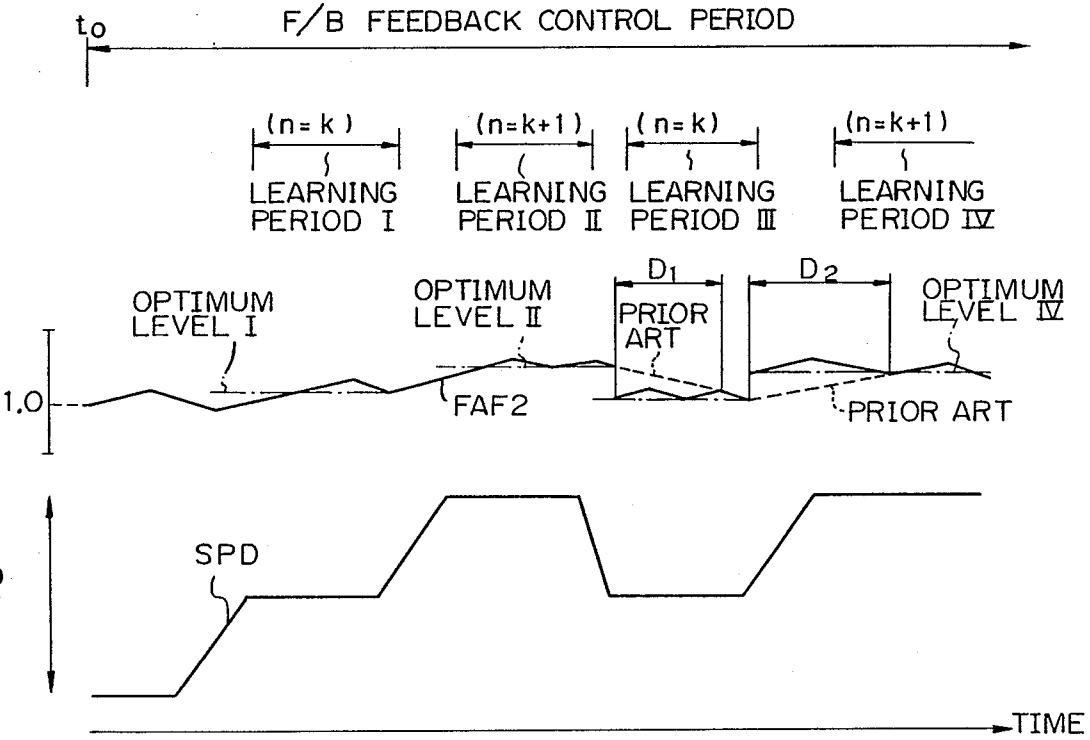

FIGS. 13A and 13B are timing diagrams for explaining the second air-fuel ratio correction amount FAF2 obtained by the flow charts of FIGS. 4, 5, 6, 8, 9, 10, and 11. In FIGS. 13A and 13B, the air-fuel ratio feedback control by the downstream-side $O_2$ sensor 15 is carried out after time $t_0$. When the vehicle speed SPD is changed as shown in FIG. 13B, the region n of the period $\overline{T}_f$ is changed and accordingly, the optimum level of the second air-fuel ratio feedback correction coefficient FAF2 is also changed (see I→II→III→IV). As a result, as shown in FIG. 13A, the second air-fuel ratio correction coefficient FAF2 is brought close to a corresponding optimum level by the air-fuel ratio feedback control by the downstream-side $O_2$ sensor 15. Further, during each learning time period I, II, III, or IV, a learning control operation is carried out, thereby renewing the learning value FAF2G(n). Here, if the optimum levels I and III belong to the same region n (=k), and the optimum levels II and IV belong to the same driving region n (=k+1), the learning value FAF2G(k) is used for the second air-fuel ratio correction coefficient FAF2 at the transition from the learning time period II to the learning time period III, and the learning value FAF2G (k+1) is used for the second air-fuel ratio correction coefficient FAF2 at the transition from the learning time period III to the learning time period IV. Therefore, in an air-fuel ratio feedback control state by the downstream-side $O_2$ sensor 15, even when the region n is changed, the second air-fuel ratio correction coefficient FAF2 promptly reaches a corresponding optimum level. Of course, even when the engine goes from an open control into an air-fuel ratio feedback control by the downstream-side $O_2$ sensor 15, the second air-fuel ratio correction coefficient FAF2 promptly reaches a corresponding optimum level, since this coefficient FAF2 also starts from the corresponding learning value FAF2G(n).

Note that, as indicated by a dotted line in FIG. 13A, when the second air-fuel ratio correction coefficient FAF2 is changed only by the air-fuel ratio feedback control of the downstream-side $O_2$ sensor 15, and the region n is changed, it takes a long time $D_1$ or $D_2$ for the coefficient FAF2 to reach a corresponding optimum level. This delay time $D_1$ or $D_2$ causes a deterioration of the fuel consumption, the drivability, and the conditions of the exhaust emissions.

A double $O_2$ sensor system, in which an air-fuel ratio feedback control parameter of the first air-fuel ratio feedback control by the upstream-side $O_2$ sensor is variable, will be explained with reference to FIGS. 14, 15, and 16. In this case, the skip amounts RSR and RSL as the air-fuel ratio feedback control parameters are variable.

Figures 14, 14A:
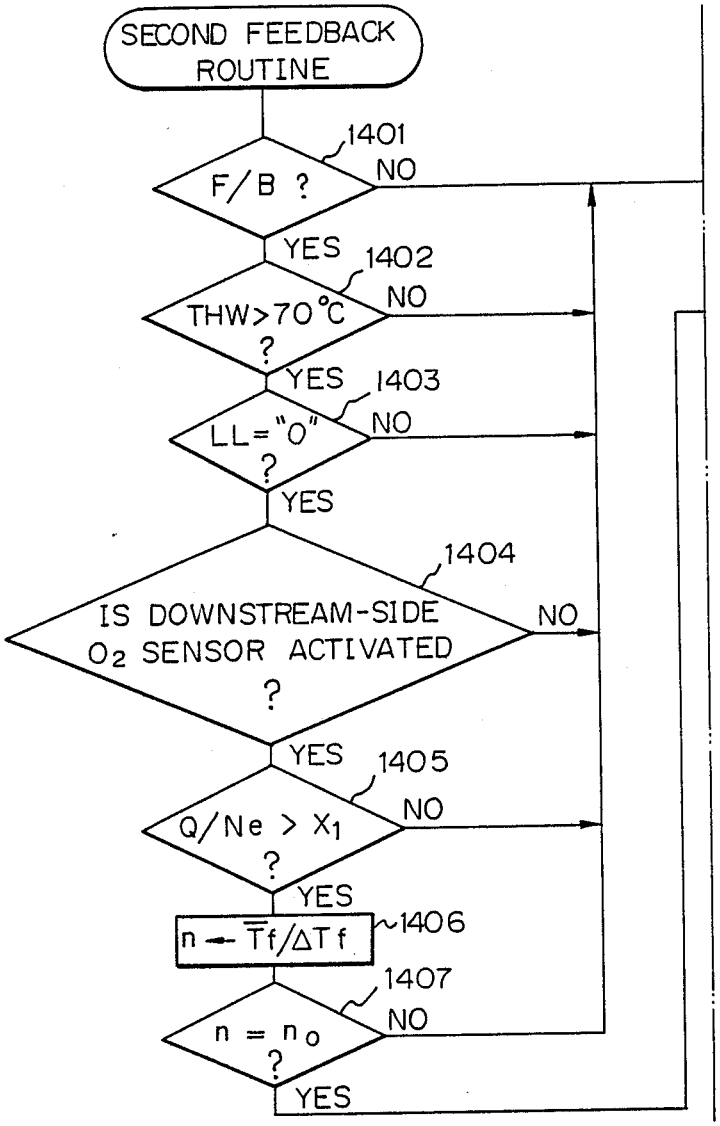
Figure 14B:
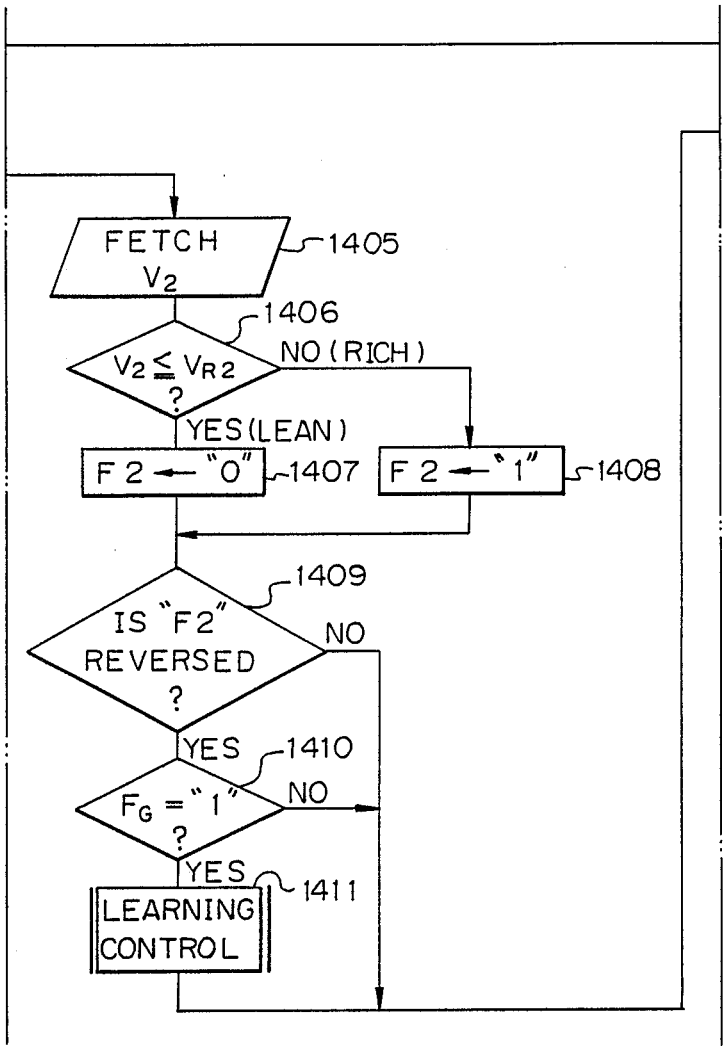
Figure 14C:
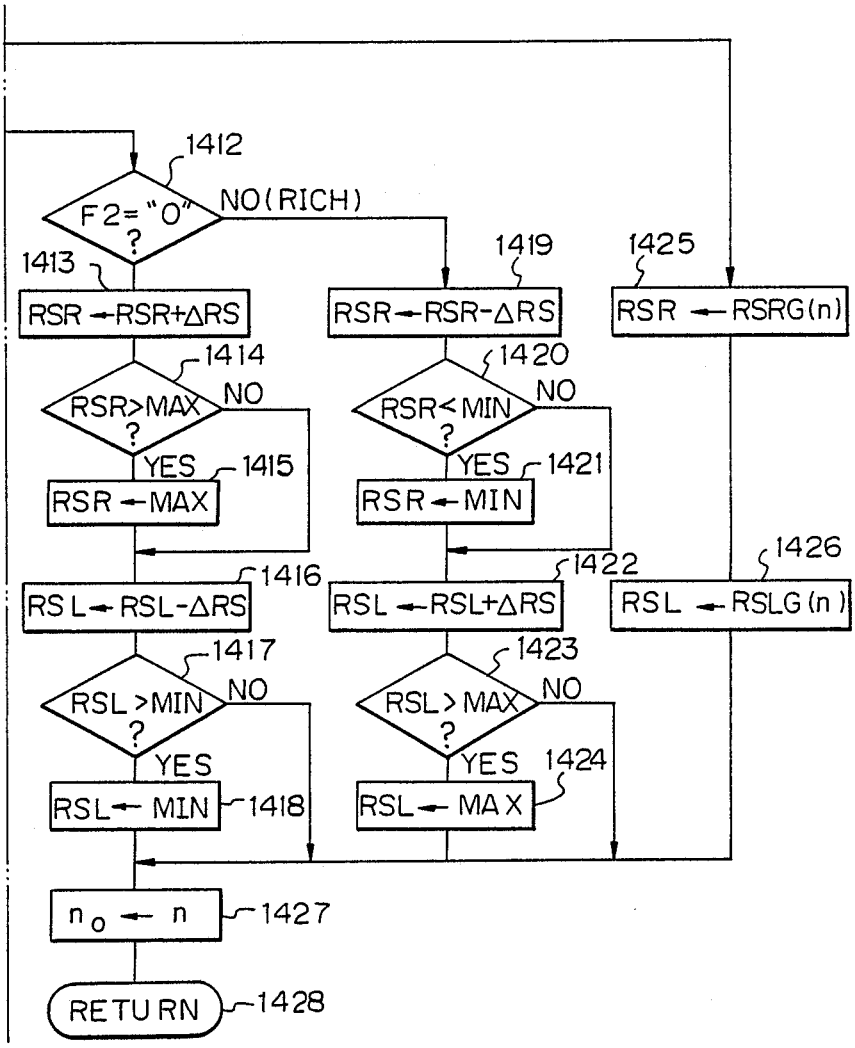

FIG. 14 is a routine for calculating the skip amount RSR and RSL in accordance with the output of the downstream-side $O_2$ sensor 15 executed at every predetermined time period such as 1 s.

Steps 1401 through 1408 are the same as steps 801 through 808 of FIG. 8.

When the air-fuel ratio feedback control conditions by the downstream-side $O_2$ sensor 15 is not satisfied, or when the region n of the period $\overline{T}_f$ is changed, at steps 1425', and 1426, the skip amounts RSR and RSL are made the learning values RSRG(n) and RSLG(n) for the corresponding region n. Note that the learning values RSRG(n) and RSLG(n) are stored in the backup RAM 106 as follows:

| n | RSRG(n) | RSLG(n) |
|---|---|---|
| 0 | RSRG(0) | RSLG(0) |
| 1 | RSRG(1) | RSLG(1) |
| . | . | . |
| . | . | . |
| . | . | . |
| k | RSRG(k) | RSLG(k) |
| . | . | . |

-continued

| n | RSRG(n) | RSLG(n) |
|---|---|---|
| . | . | . |
| . | . | . |

At step 1409, it is determined whether or not the second air-fuel ratio flag F2 is reversed. If the second air-fuel ratio flag F2 is reversed, the control proceeds to step 1410 which determines whether or not all the learning conditions are satisfied, i.e., the learning control execution flag $F_G$ is "1". Only if all the learning conditions are satisfied does the control proceeds to step 1411, which carries out a learning control operation. Note that the learning control execution flag $F_G$ is also determined by the routine of FIG. 9. Step 1411 will be later explained with reference to FIG. 15.

At step 1412, it is determined whether or not the second air-fuel ratio F2 is "0". If F2="0", which means that the air-fuel ratio is lean, the control proceeds to steps 1413 through 1418, and if F2="1", which means that the air-fuel ratio is rich, the control proceeds to steps 1419 through 1424.

At step 1413, the rich skip amount RSR is increased by a definite value ΔRS which is, for example, 0.08, to move the air-fuel ratio to the rich side. At steps 1414 and 1415, the rich skip amount RSR is guarded by a maximum value MAX which is, for example, 7.5%. Further, at step 1416, the lean skip amount RSL is decreased by the definite value ΔRS to move the air-fuel ratio to the lean side. At steps 1417 and 1418, the lean skip amount RSL is guarded by a minimum value MIN which is, for example 2.5%.

On the other hand, at step 1419, the rich skip amount RSR is decreased by the definite value ΔRS to move the air-fuel ratio to the lean side. At steps 1420 and 1421, the rich skip amount RSR is guarded by the minimum value MIN. Further, at step 1422, the lean skip amount RSL is decreased by the definite value ΔRS to move the air-fuel ratio to the rich side. At steps 1423 and 1424, the lean skip amount RSL is guarded by the maximum value MAX.

At step 1407, the region n is stored as the previous driving region $n_0$ in the RAM 105 in order to execute the next operation.

The skip amounts RSR and RSL are then stored in the RAM 105, thereby completing this routine of FIG. 14 at step 1428.

In FIG. 14, the minimum value MIN is a level by which the transient characteristics of the skip operation using the amounts RSR and RSL can be maintained, and the maximum value MAX is a level by which the drivability is not deteriorated by the fluctuation of the air-fuel ratio.

Thus, according to the routine of FIG. 14, when the output of the second $O_2$ sensor 15 is lean, the rich skip amount RSR is gradually increased, and the lean skip amount RSL is gradually decreased, thereby moving the air-fuel ratio to the rich side. Contrary to this, when the output of the second $O_2$ sensor 15 is rich, the rich skip amount RSR is gradually decreased, and the lean skip amount RSL is gradually increased, thereby moving the air-fuel ratio to the lean side. Also, in an open-loop control state, the skip amounts RSR and RSL are made the corresponding learning values RSRG(n) and RSLG(n), respectively.

Figure 15:
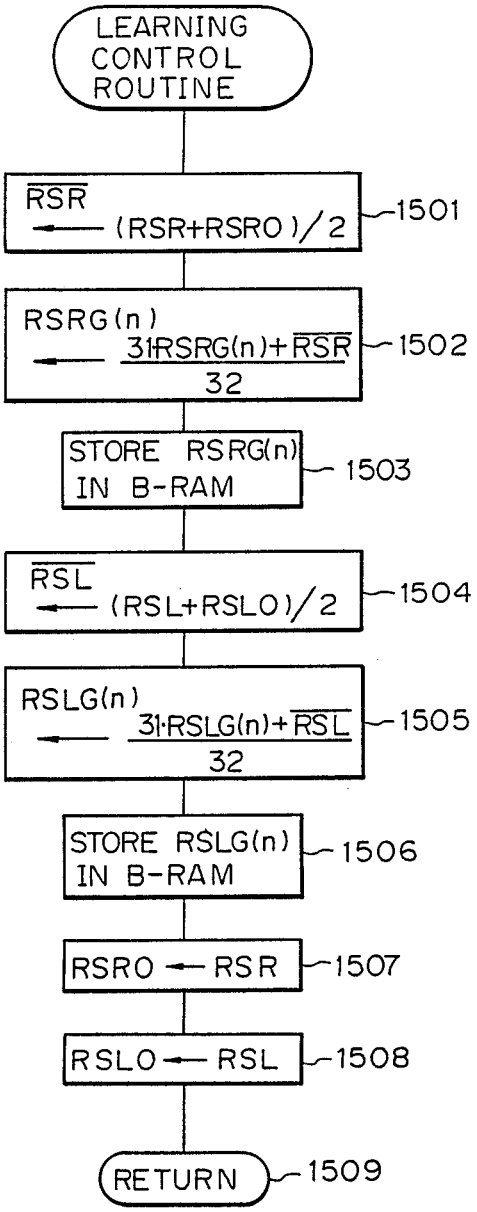

FIG. 15 is a detailed routine of the learning control step 1411 of FIG. 14. As explained above, this routine is carried out when the output of the downstream-side $O_2$ sensor 15 is reversed and all of the learning conditions are satisfied. At step 1501, a mean value $\overline{RSR}$ of the rich skip amount RSR is calculated by $$\overline{RSR} \leftarrow (RSR + RSRO)/2$$

Where RSRO is a value of the rich skip amount RSR fetched previously at a skip operation. That is, the mean value RSR is a mean value of two successive values of the rich skip amount RSR immediately before the skip operations. Next, at step 1502, the learning value RSRG(n) for the current region n is renewed by $$RSRG(n) \leftarrow \frac{31 \cdot RSRG(n) + \overline{RSR}}{32}$$

Then, at step 1503, the learning value RSRG(n) is stored in the corresponding area of the backup RAM 106. That is, the learning value RSRG(n) is a blunt value of the mean value $\overline{RSR}$ of the rich skip amount RSR. Then, at step 1503, the learning value RSRG(n) is stored in the backup RAM 106.

Similarly, at step 1504, a mean value $\overline{RSL}$ of the lean skip amount RSL is calculated by $$\overline{RSL} \leftarrow (RSL + RSLO)/2$$

That is, the mean value $\overline{RSL}$ is a mean value of two successive values of the lean skip amount RSL immediately before the skip operations. Next, at step 1505, the learning value RSLG(n) for the current region n is renewed by $$RSLG(n) \leftarrow \frac{31 \cdot RSLG(n) + RSL}{32}$$

Then, at step 1506, the learning value RSLG(n) is stored in the corresponding area of the backup RAM 106.

At steps 1507 and 1508, in order to prepare the next operation, $$RSRO \leftarrow RSR$$

$$RSLO \leftarrow RSL.$$

Thus, this routine of FIG. 15 is completed by step 1509.

Note that, also in FIG. 15, steps 1502 and 1505 can be deleted, and in this case, the learning values RSRG(n) and RSLG(n) are made the mean values RSR and RSL, respectively.

Thus, a learning control operation is performed upon the skip amounts $\overline{RSR}$ and e,ovs/RSL/ , and the obtained learning values RSRG(n) and RSLG(n) are used as the skip amounts RSR and RSL at the start of the air-fuel ratio feedback control by the downstream-side $O_2$ sensor 15, and at the change of regions of the output period $\overline{T}_f$ in an air-fuel ratio feedback control.

Figure 16:
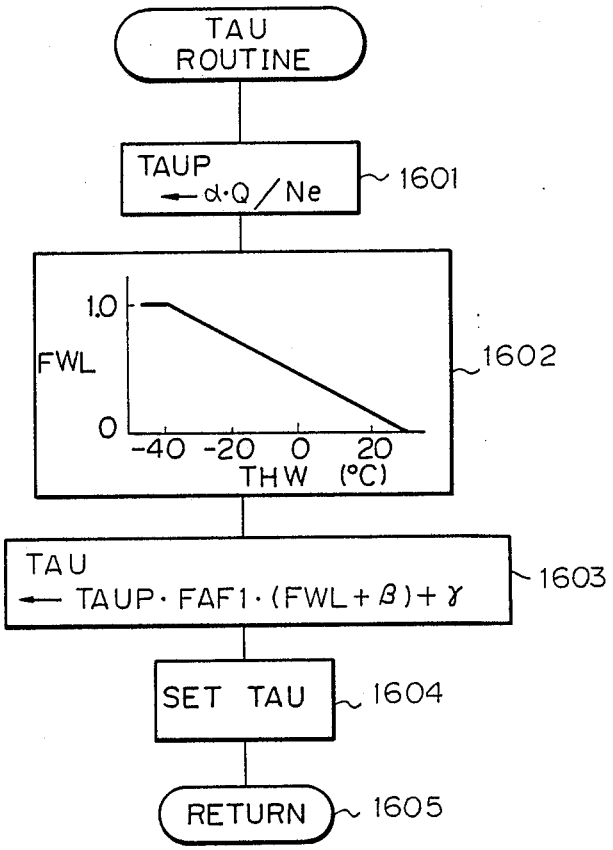

FIG. 16 is a routine for calculating a fuel injection amount TAU executed at every predetermined crank angle such as 360° CA. At step 1601, a base fuel injection amount TAUP is calculated by using the intake air amount data Q and the engine speed data Ne stored in the RAM 105. That is, $$TAUP \leftarrow \alpha \cdot Q/Ne$$

Where $\alpha$ is a constant. Then at step 1602, a warming-up incremental amount FWL is calculated from a one-dimensional map by using the coolant temperature data THW stored in the RAM 105. Note that the warming-up incremental amount FWL decreases when the coolant temperature THW increases. At step 1603, a final fuel injection amount TAU is calculated by $$TAU \leftarrow TAUP \cdot FAF1 \cdot (FWL + \beta) + \gamma$$

Where $\beta$ and $\gamma$ are correction factors determined by other parameters such as the voltage of the battery and the temperature of the intake air. At step 1604, the final fuel injection amount TAU is set in the down counter 108, and in addition, the flip-flop 109 is set to initiate the activation of the fuel injection valve 7. Then, this routine is completed by step 1605. Note that, as explained above, when a time period corresponding to the amount TAU has passed, the flip-flop 109 is reset by the carry-out signal of the down counter 108 to stop the activation of the fuel injection valve 7.

Figures 17A, 17B, 17C, 17D, 17E, 17F, 17G, 17H:
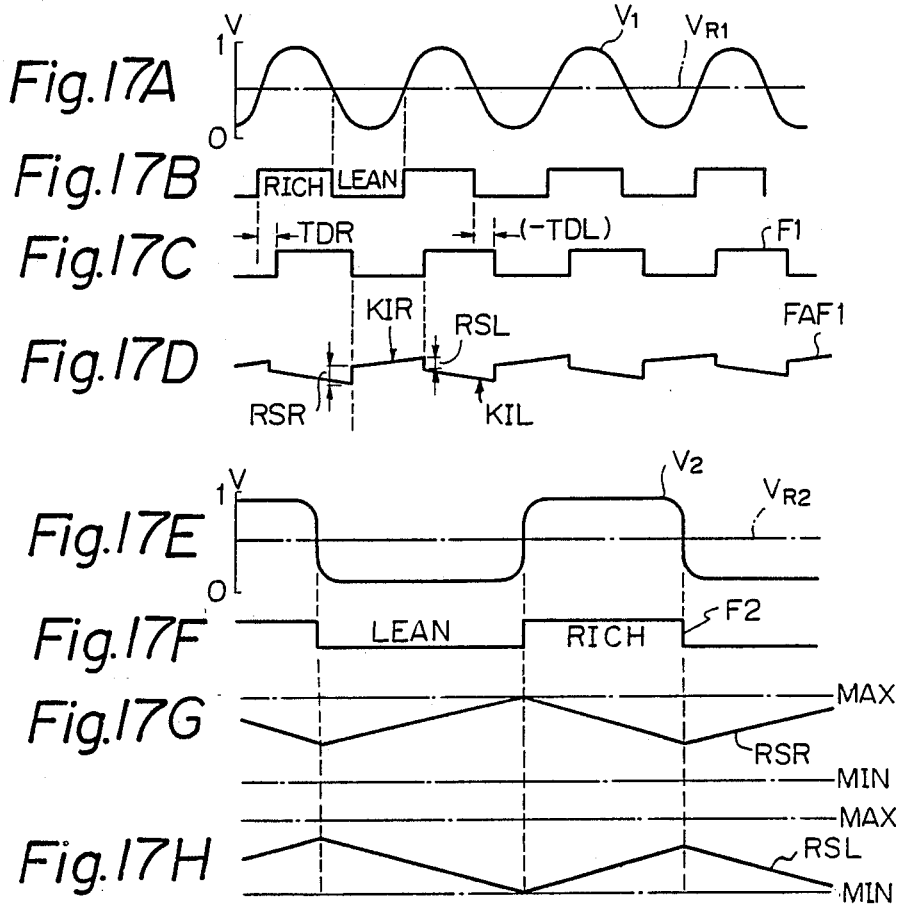
FIGS. 17A through 17H, 18A, and 18B are timing diagrams explaining the flow charts of FIGS. 4, 4A–4C, 5, 6, 9, 14, 14A–14C, 15, and 16.

FIGS. 17A through 17G are timing diagrams for explaining the air-fuel ratio correction amount FAF1 and the skip amounts RSR and RSL obtained by the flow charts of FIGS. 4, 5, 6, 9, 14, and 16. FIGS. 17A through 17F are the same as FIGS. 12A through 12F, respectively. As shown in FIGS. 17G and 17H, when the determination F2 is lean, the rich skip amount RSR is increased and the lean skip amount RSL is decreased, and when the determination F2 is rich, the rich skip amount RSR is decreased and the lean skip amount RSL is increased. In this case, the skip amounts RSR and RSL are changed within a range from MAX to MIN.

Figures 18A, 18B:
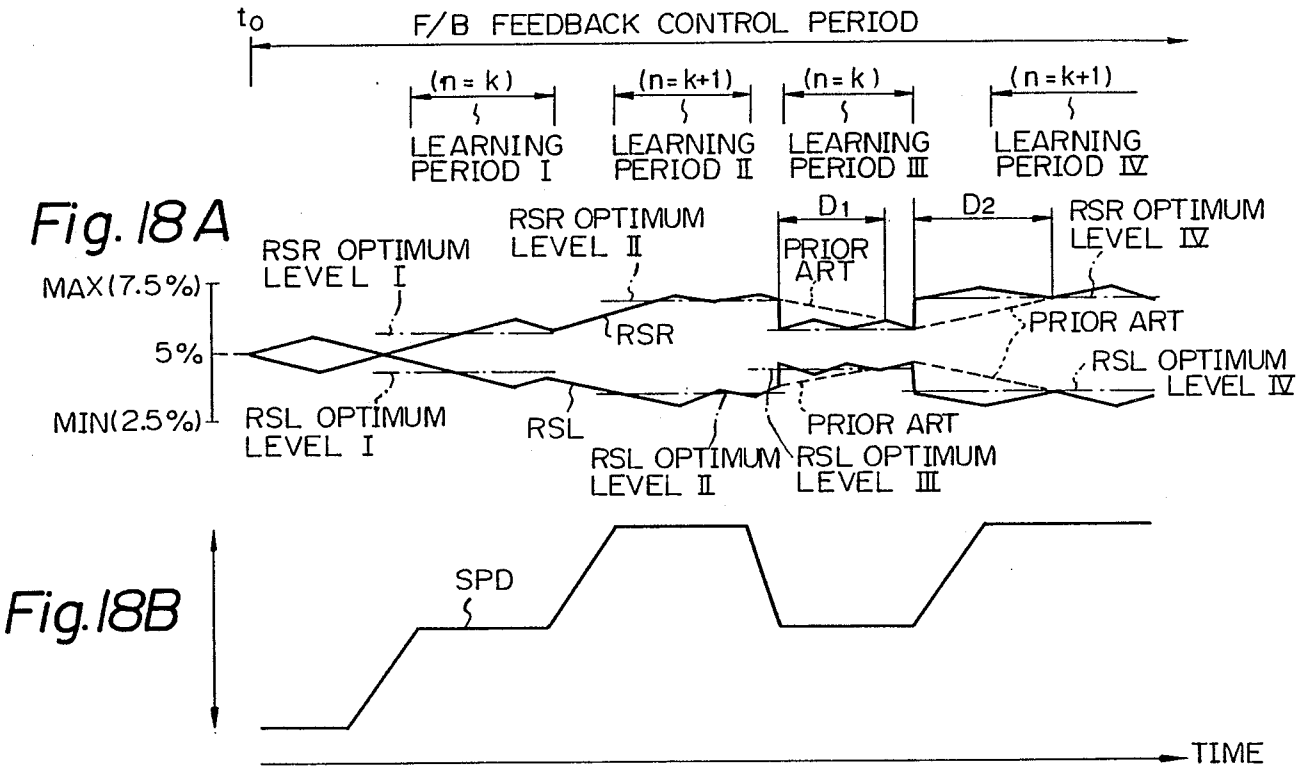

FIGS. 18A and 18B are timing diagrams for explaining the skip amounts RSR and RSL obtained by the flow charts of FIGS. 4, 5, 9, 14, and 16. That is, the routines of FIGS. 14 and 15 are used instead of those of FIGS. 8 and 10. In FIGS. 18A and 18B, the air-fuel ratio feedback control by the downstream-side $O_2$ sensor 15 is carried out after time $t_0$. When the vehicle speed SPD is changed as shown in FIG. 18B, the region n is changed, and accordingly, the optimum levels of the skip amounts RSR and RSL are also changed (see I→II→III→IV). As a result, as shown in FIG. 18A, the skip amounts RSR and RSL are brought close to their corresponding optimum levels by the air-fuel ratio feedback control by the downstream side $O_2$ sensor 15. Further, during each learning time period I, II, III, or IV, a learning control operation is carried out, thereby renewing the learning values RSRG(n) and RSLG(n). Here, if the optimum levels I and III belong to the same region n (=k), and the optimum levels II and IV belong to the same region n (=k+1), the learning values RSRG(k) and RSLG(K) are used for the skip amounts RSR and RSL, respectively, at the transition from the learning time period II to the learning time period III, and the learning values RSRG(n) and RSLG(n) are used for the skip amounts RSR and RSL, respectively, at the transition from the learning time period III to the learning time period IV. Therefore, in an air-fuel ratio feedback control state by the downstream-side $O_2$ sensor 15, even when the region n is changed, the skip amounts RSR and RSL promptly reach their corresponding optimum levels. Of course, even when the engine goes from an open control to an air-fuel ratio feedback control by the downstream-side $O_2$ sensor 15, the skip amounts RSR and RSL promptly reach their corresponding optimum levels, since the skip amounts RSR and RSL also start from their corresponding learning values RSRG(n) and RSLG(n).

Note that, as indicated by a dotted line in FIG. 18A, when the skip amounts RSR and RSL are changed only by the air-fuel ratio feedback control of the downstream-side $O_2$ sensor 15, and the region n is changed, it takes a long time $D_1$ or $D_2$ for the skip amounts RSR and RSL to reach their corresponding optimum levels. This delay time $D_1$ or $D_2$ causes a deterioration of the fuel consumption, the drivability, and the conditions of the exhaust emissions.

Note that the value $\Delta T_f$ at steps 806 and 1406 can be variable. In this case, the magnitude of the above-mentioned regions is not the same.

Also, in the above-mentioned embodiments, although a mean value $\overline{FAF2}$ (or $\overline{RSR}$, $\overline{RSL}$) is obtained by two successive values immediately before skip operations, such a mean value can be obtained by integrating the corresponding value.

Figure 19:
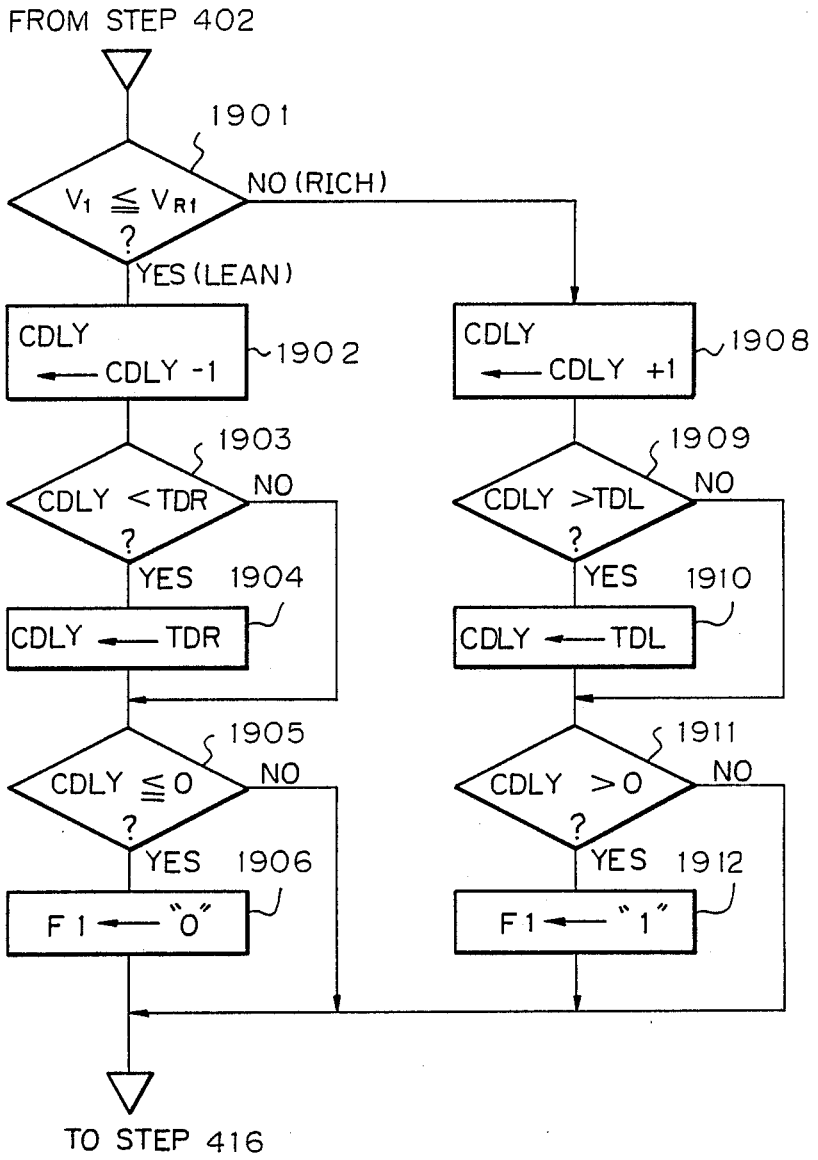

In FIG. 19, which is a modification of FIG. 4, a delay operation different from the of FIG. 4 is carried out. That is, at step 1901, if $V_1 \leqq V_{R1}$, which means that the current air-fuel ratio is lean, the control proceeds to steps 2202 which decreases a delay counter CDLY by 1. Then, at step 1903, and 1904, the delay counter CDLY is guarded by a minimum value TDR. Note that TDR is a rich delay time period for which a lean state is maintained even after the output of the upstream-side $O_2$ sensor 13 is changed from the lean side to the rich side, and is defined by a negative value.

Note that, in this case, if CDLY>0, then the delayed air-fuel ratio is rich, and if CDLY≦0, then the delayed air-fuel ratio is lean.

Therefore, at step 1905, it is determined whether or not CDLY ≦0 is satisfied. As a result, if CDLY<0, at step 1906, the first air-fuel ratio flag F1 is made "0" (lean). Otherwise, the first air-fuel ratio flag F1 is unchanged, that is, the flag F1 remains at "1".

On the other hand, if $V_1 > V_{R1}$, which means that the current air-fuel ratio is rich, the control proceeds to step 1908 which increases the delay counter CDLY by 1. Then, at steps 1909 and 1910, the delay counter CDLY1 is guarded by a maximum value TDL1. Note that TDL is a lean delay time period for which a rich state is maintained even after the output of the upstream-side $O_2$ sensor 13 is changed from the rich side to the lean side, and is defined by a positive value.

Then, at step 1911, it is determined whether or not CDLY>0 is satisfied. As a result, if CDLY>0, at step 1912, the first air-fuel ratio flag F1 is made "1" (rich). Otherwise, the first air-fuel ratio flag F1 is unchanged, that is, the flag F1 remains at "0".

Figures 20A, 20B, 20C, 20D:
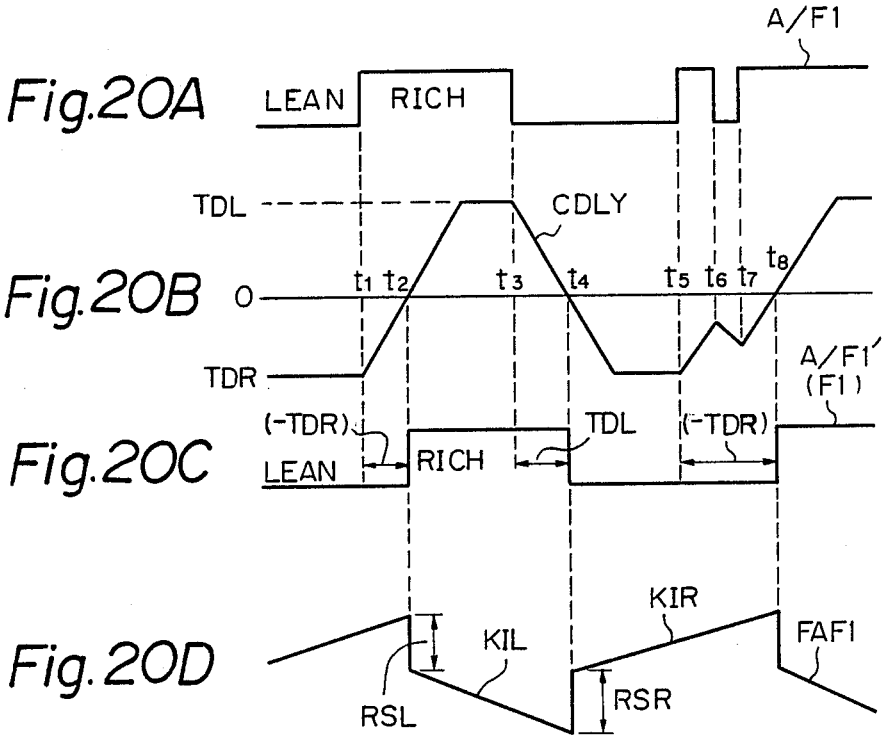
FIGS. 20A through 20D are timing diagrams explaining the flow chart of FIG. 19.

The operation by the flow chart of FIG. 20 will be further explained with reference to FIGS. 19A through 19D. As illustrated in FIGS. 19A, when the air-fuel ratio A/F1 is obtained by the output of the upstream-side $O_2$ sensor 13, the delay counter CDLY is counted up during a rich state, and is counted down during a lean state, as illustrated in FIG. 19B. As a result, the delayed air-fuel ratio A/F1′ is obtained as illustrated in FIG. 19C. For example, at time $t_1$, even when the air-fuel ratio A/F1 is changed from the lean side to the rich side, the delayed air-fuel ratio A/F1 is changed at time $t_2$ after the rich delay time period TDR. Similarly, at time $t_3$, even when the air-fuel ratio A/F1 is changed from the rich side to the lean side, the delayed air-fuel ratio A/F1′ is changed at time $t_4$ after the lean delay time period TDL. However, at time $t_5$, $t_6$, or $t_7$ when the air-fuel ratio A/F1 is reversed within a smaller time period than the rich delay time period TDR or the lean delay time period TDL, the delayed air-fuel ratio A/F1′ is reversed at time $t_8$. That is, the delayed air-fuel ratio A/F1′ is stable when compared with the air-fuel ratio A/F1. Further, as illustrated in FIG. 19D, at every change of the delayed air-fuel ratio A/F1′ from the rich side to the lean side, or vice versa, the correction amount FAF1 is skipped by the skip amount RSR or RSL, and also, the correction amount FAF1 is gradually increased or decreased in accordance with the delayed air-fuel ratio A/F1′.

Note that, in this case, during an open-control mode, the rich delay time period TDR is, for example, −12 (48 ms), and the lean delay time period TDL is, for example, 6 (24 ms).

Also, the first air-fuel ratio feedback control by the upstream-side $0_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR and TDL, or the reference voltage $V_{R1}$, are variable.

Still further, a Karman vortex sensor, a heat-wire type flow sensor, and the like can be used instead of the airflow meter.

Although, in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 1101 of FIG. 11 or at step 1601 of FIG. 16 is determined by the carburetor itself, i.e., the intake air negative pressure and the engine speed, and the air amount corresponding to TAU at step 1103 of FIG. 11 or at step 1603 of FIG. 16.

Further, a CO sensor, a lean-mixture sensor or the like can be also used instead of the $O_2$ sensor.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

calculating a first air-fuel ratio correction amount in accordance with the output of said upstream-side air-fuel ratio sensor;

determining whether said engine is in an air-fuel ratio feedback control state or in an open control state for said downstream-side air-fuel ratio sensor;

calculating a second air-fuel ratio correction amount in accordance with the output of said downstream-side air-fuel ratio sensor when said engine is in said air-fuel ratio feedback control state;

determining whether or not said engine is in a learning control state;

calculating a period of the output of said upstream-side air-fuel ratio sensor;

determining a region defined by the output period of said upstream-side air-fuel ratio sensor;

calculating a center value of said second air-fuel ratio correction amount when said engine is in said learning control state and said calculated period remains in the same region;

storing said center value of said second air-fuel ratio correction amount of the same region;

setting said center value of said second air-fuel ratio correction amount stored for the current region in said second air-fuel ratio correction amount when said engine is transferred from said open control state to said air-fuel ratio feedback control state or when said calculated period is transferred to a different region in said air-fuel ratio feedback control state; and adjusting an actual air-fuel ratio in accordance with said first and second air-fuel ratio correction amounts.

2. A method as set forth in claim 1, wherein said period calculating step calculates a blunt value of said calculated period.

3. A method as set forth in claim 1, wherein said center value setting step further sets said stored center value of said second air-fuel ratio correction amount stored for the current region in said second air-fuel correction amount, when said engine is in said open control state.

4. A method as set forth in claim 1, wherein said center value calculating step comprises a step of calculating a mean value of two successive second air-fuel correction amounts at the switching of the output of said downstream-side air-fuel ratio sensor.

5. A method as set forth in claim 4, wherein said center value calculating step further comprises a step of calculating a blunt value of said mean value of two successive second air-fuel correction amounts at the switching of the output of said downstream-side air-fuel ratio sensor.

6. A method as set forth in claim 1, wherein said center value calculating step calculates an integration value of said second air-fuel ratio correction amount as said center value thereof.

7. A method as set forth in claim 1, wherein said learning control state determining step comprises the steps of:

determining whether or not said engine is in an air-fuel ratio feedback control state by both of said first and second air-fuel ratio sensors;

determining whether or not a coolant temperature of said engine is within a predetermined range;

determining whether or not a duration, during which a change of an engine load parameter is smaller than a predetermined value, exceeds a predetermined duration; and setting said learning control state only when all of the above-mentioned determinations are affirmative.

8. A method as set forth in claim 1, wherein said regions are determined by equalization thereof.

9. A method as set forth in claim 1, wherein said regions are determined by nonequalization there of.

10. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

determining whether said engine is in an air-fuel ratio feedback control state or in an open control state for said second air-fuel ratio sensor;

calculating an air-fuel ratio feedback control parameter in accordance with the output of said downstream-side air-fuel ratio sensor when said engine is in said air-fuel ratio feedback control state;

determining whether or not said engine is in a learning control state;

calculating a period of the output of said upstream-side air-fuel ratio sensor;

determining a region defined by the output period of said upstream-side air-fuel ratio sensor;

calculating a center value of said air-fuel ratio feedback control parameter when said engine is in said learning control state and said calculated period remains in the same region;

storing said center value of said air-fuel ratio feedback control parameter for the same region;

setting said center value of said air-fuel ratio feedback control parameter stored for the current region in said air-fuel ratio feedback control parameter when said engine is transferred from said open control state to said air-fuel ratio feedback control state or when said calculated region is transferred to a different region in said air-fuel ratio feedback control state;

calculating an air-fuel ratio correction accordance with the output of said upstream-side air-fuel ratio sensor and said air-fuel ratio feedback control parameter; and adjusting an actual air-fuel ratio in accordance with said air-fuel ratio correction amount.

11. A method as set forth in claim 10, wherein said period calculating step calculates a blunt value of said period.

12. A method as set forth in claim 10, wherein said center value setting step further sets said stored center value of said air-fuel ratio feedback control parameter stored for the current region in said second air-fuel correction amount, when said engine is in said open control state.

13. A method as set forth in claim 10, wherein said center value calculating step comprises a step of calculating a mean value of two successive air-fuel ratio feedback control parameters at the switching of the output of said downstream-side air-fuel ratio sensor.

14. A method as set forth in claim 13, wherein said center value calculating step further comprises a step of calculating a blunt value of said mean value of two successive air-fuel ratio feedback control parameters at the switching of the output of said downstream-side air-fuel ratio sensor.

15. A method as set forth in claim 10, wherein said center value calculating step calculates an integration value of said air-fuel ratio feedback control parameter as said center value thereof.

16. A method as set forth in claim 10, wherein said learning control state determining step comprises the steps of:

determining whether or not said engine is in an air-fuel ratio feedback control state by both of said first and second air-fuel ratio sensors;

determining whether or not a coolant temperature of said engine is within a predetermined range;

determining whether or not a duration, during which a change of an engine load parameter is smaller than a predetermined value, exceeds a predetermined duration; and setting said learning control state only when all of the above-mentioned determinations are affirmative.

17. A method as set forth in claim 10, wherein said regions are determined by equalization thereof.

18. A method as set forth in claim 10, wherein said regions are determined by nonequalization thereof.

19. A method as set forth in claim 10, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich said to the lean side.

20. A method as set forth in claim 10, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

21. A method as set forth in claim 10, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

22. A method as set forth in claim 10, wherein said air-fuel ratio feedback control parameter is defined by a reference voltage with which the output of said upstream-side air-fuel ratio is compared, thereby determining whether the output of said upstream-side air-fuel ratio sensor is on the rich side or on the lean side.

23. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for calculating a first air-fuel ratio correction amount in accordance with the output of said upstream-side air-fuel ratio sensor;

means for determining whether said engine is in an air-fuel ratio feedback control state or in an open control state for said downstream-side air-fuel ratio sensor;

means for calculating a second air-fuel ratio correction amount in accordance with the output of said downstream-side air-fuel ratio sensor when said engine is in said air-fuel ratio feedback control state;

means for determining whether or not said engine is in a learning control state;

means for calculating a period of the output of said upstream-side air-fuel ratio sensor;

means for determining a region defined by the output period of said upstream-side air-fuel ratio sensor;

means for calculating a center value of said second air-fuel ratio correction amount when said engine is in said learning control state and said calculated period remains in the same region;

means for storing said center value of said second air-fuel ratio correction amount for the same region;

means for setting said center value of said second air-fuel ratio correction amount stored for the current region in said second air-fuel ratio correction amount when said engine is transferred from said open control state to said air-fuel ratio feedback control state or when said calculated period is transferred to a different region in said air-fuel ratio feedback control state; and means for adjusting an actual air-fuel ratio in accordance with said first and second air-fuel ratio correction amounts.

24. An apparatus as set forth in claim 23, wherein said period calculating means calculates a blunt value of said calculated period.

25. An apparatus as set forth in claim 23, wherein said center value setting means further sets said stored center value of said second air-fuel ratio correction amount for the current region in said second air-fuel correction amount, when said engine is in said open control state.

26. An apparatus as set forth in claim 23, wherein said center value calculating means comprises means for calculating a mean value of two successive second air-fuel correction amounts at the switching of the output of said downstream-side air-fuel ratio sensor.

27. An apparatus as set forth in claim 26, wherein said center value calculating means further comprises means for calculating a blunt value of said mean value of two successive second air-fuel correction amounts at the switching of the output of said downstream-side air-fuel ratio sensor.

28. An apparatus as set forth in claim 23, wherein said center value calculating means calculates an integration value of said second air-fuel ratio correction amount as said center value thereof.

29. An apparatus as set forth in claim 23, wherein said learning control state determining means comprises:

means for determining whether or not said engine is in an air-fuel ratio feedback control state by both of said first and second air-fuel ratio sensors;

means for determining whether or not a coolant temperature of said engine is within a predetermined range;

means for determining whether or not a duration, during which a change of an engine load parameter is smaller than a predetermined value, exceeds a predetermined duration; and means for setting said learning control state only when all of the above-mentioned determinations are affirmative.

30. An apparatus as set forth in claim 23, wherein said regions are determined by equalization thereof.

31. An apparatus as set forth in claim 23, wherein said regions are determined by nonequalization thereof.

32. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for determining whether said engine is in an air-fuel feedback control state or in an open control state for said second air-fuel ratio sensor;

means for calculating an air-fuel ratio feedback control parameter in accordance with the output of said downstream-side air-fuel ratio sensor when said engine is in said air-fuel ratio feedback control state;

means for determining whether or not said engine is in a learning control state;

means for calculating a period of the output of said upstream-side air-fuel ratio sensor;

means for determining a region defined by the output period of said upstream-side air-fuel ratio sensor;

means for calculating a center value of said air-fuel ratio feedback control parameter when said engine is in said learning control state and said calculated period remains in the same region;

means for storing said center value of said air-fuel ratio feedback control parameter for the same region;

means for setting said center value of said air-fuel ratio feedback control parameter stored for the current region in said air-fuel ratio feedback control parameter when said engine is transferred from said open control state to said air-fuel ratio feedback control state or when said calculated region is transferred to a different region in said air-fuel ratio feedback control state;

means for calculating an air-fuel ratio correction amount in accordance with the output of said upstream-side air-fuel ratio sensor and said air-fuel ratio feedback control parameter; and means for adjusting an actual air-fuel ratio in accordance with said air-fuel ratio correction amount.

33. An apparatus as set forth in claim 32, wherein said period calculating means calculates a blunt value of said period.

34. An apparatus as set forth in claim 32, wherein said center value setting means further sets said stored center value of said air-fuel ratio feedback control parameter stored for the current region in said second air-fuel correction amount, when said engine is in said open control state.

35. An apparatus as set forth in claim 32, wherein said center value calculating means comprises means for calculating a mean value of two successive air-fuel ratio feedback control parameters at the switching of the output of said downstream-side air-fuel ratio sensor.

36. An apparatus as set forth in claim 35, wherein said center value calculating means further comprises means for calculating a blunt value of said mean value of two successive air-fuel ratio feedback control parameters at the switching of the output of said downstream-side air-fuel ratio sensor.

37. An apparatus as set forth in claim 32, wherein said center value calculating means calculates an integration value of said air-fuel ratio feedback control parameter as said center value thereof.

38. An apparatus as set forth in claim 32, wherein said learning control state determining means comprises:

means for determining whether or not said engine is in an air-fuel ratio feedback control state by both of said first and second air-fuel ratio sensors;

means for determining whether or not a coolant temperature of said engine is within a predetermined range;

means for determining whether or not a duration, during which a change of an engine load parameter is smaller than a predetermined value, exceeds a predetermined duration; and means for setting said learning control state only when all of the above-mentioned determinations are affirmative.

39. An apparatus as set forth in claim 32, wherein said regions are determined by equalization thereof.

40. An apparatus as set forth in claim 32, wherein said regions are determined by nonequalization thereof.

41. An apparatus as set forth in claim 32, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich said to the lean side.

42. An apparatus as set forth in claim 32, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

43. An apparatus as set forth in claim 32, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

44. An apparatus as set forth in claim 32, wherein said air-fuel ratio feedback control parameter is defined by a reference voltage with which the output of said upstream-side air-fuel ratio is compared, thereby determining whether the output of said upstream-side air-fuel ratio sensor is on the rich side or on the lean side.

* * * * *